US007980334B2

(12) United States Patent
Voronin et al.

(10) Patent No.: US 7,980,334 B2
(45) Date of Patent: Jul. 19, 2011

(54) DIAMOND-BONDED CONSTRUCTIONS WITH IMPROVED THERMAL AND MECHANICAL PROPERTIES

(75) Inventors: Georgiy Voronin, Orem, UT (US); J. Daniel Belnap, Pleasant Grove, UT (US)

(73) Assignee: Smith International, Inc., Houston, TX (US)

( * ) Notice: Subject to any disclaimer, the term of this patent is extended or adjusted under 35 U.S.C. 154(b) by 193 days.

(21) Appl. No.: 11/867,629

(22) Filed: Oct. 4, 2007

(65) Prior Publication Data

US 2009/0090563 A1 Apr. 9, 2009

(51) Int. Cl.
*E21B 10/36* (2006.01)

(52) U.S. Cl. ..... 175/428; 175/420.2

(58) Field of Classification Search ..... 175/428, 175/420.2; 419/11, 17

See application file for complete search history.

(56) References Cited

U.S. PATENT DOCUMENTS

| | | | |
|---|---|---|---|
| 3,136,615 | A | 6/1964 | Bovenkerk et al. |
| 3,141,746 | A | 7/1964 | Lai |
| 3,233,988 | A | 2/1966 | Wentorf, Jr. et al. |
| 3,745,623 | A | 7/1973 | Wentorf, Jr. et al. |
| 4,108,614 | A | 8/1978 | Mitchell |
| 4,151,686 | A | 5/1979 | Lee et al. |
| 4,224,380 | A | 9/1980 | Bovenkerk et al. |
| 4,255,165 | A | 3/1981 | Dennis et al. |
| 4,268,276 | A | 5/1981 | Bovenkerk |
| 4,288,248 | A | 9/1981 | Bovenkerk et al. |
| 4,303,442 | A | 12/1981 | Hara et al. |
| 4,311,490 | A | 1/1982 | Bovenkerk et al. |
| 4,373,593 | A | 2/1983 | Phaal et al. |
| 4,387,287 | A | 6/1983 | Marazzi |
| 4,412,980 | A | 11/1983 | Tsuji et al. |
| 4,481,016 | A | 11/1984 | Campbell et al. |
| 4,486,286 | A | 12/1984 | Lewin et al. |

(Continued)

FOREIGN PATENT DOCUMENTS

CA 2639727 A1 4/2009

(Continued)

OTHER PUBLICATIONS http://www.astro.virginia.edu/class/oconnell/astr121/im/periodic_table.gif "Periodic Table".*

(Continued)

*Primary Examiner* — Kenneth Thompson
*Assistant Examiner* — Cathleen R Hutchins
(74) *Attorney, Agent, or Firm* — Osha • Liang LLP

(57) ABSTRACT

Diamond-bonded constructions include a diamond-bonded body having a thermally stable region extending a distance below a diamond-bonded body surface. The thermally stable region comprises a matrix phase of bonded-together diamond crystals, and interstitial regions comprising a reaction product. The reaction product is formed by reaction between the diamond crystals and a reactive material. The reactant is a carbide former and the reaction product is a carbide. The diamond-bonded body includes a further diamond region extending from the thermally stable region that comprises the matrix phase and a Group VIII metal disposed within interstitial regions of the matrix phase. The thermally stable region is substantially free of a catalyst material used to initially form the diamond-bonded body. The diamond-bonded body may include a material layer formed from the reaction product that is disposed on a surface of the diamond-bonded body thermally stable region.

31 Claims, 8 Drawing Sheets

U.S. PATENT DOCUMENTS 4,504,519 A 3/1985 Zelez
4,522,633 A 6/1985 Dyer
4,525,179 A 6/1985 Gigl
4,534,773 A 8/1985 Phaal et al.
4,556,403 A 12/1985 Almond et al.
4,560,014 A 12/1985 Geczy
4,570,726 A 2/1986 Hall
4,572,722 A 2/1986 Dyer
4,604,106 A 8/1986 Hall
4,605,343 A 8/1986 Hibbs, Jr. et al.
4,606,738 A 8/1986 Hayden
4,621,031 A 11/1986 Scruggs
4,636,253 A 1/1987 Nakai et al.
4,645,977 A 2/1987 Kurokawa et al.
4,662,348 A 5/1987 Hall et al.
4,664,705 A 5/1987 Horton et al.
4,670,025 A 6/1987 Pipkin
4,707,384 A 11/1987 Schachner et al.
4,726,718 A 2/1988 Meskin et al.
4,766,040 A 8/1988 Hillert et al.
4,776,861 A 10/1988 Frushour
4,784,023 A 11/1988 Dennis
4,792,001 A 12/1988 Zijsling
4,793,828 A 12/1988 Burnand
4,797,241 A 1/1989 Peterson et al.
4,798,026 A 1/1989 Cerceau
4,802,539 A 2/1989 Hall et al.
4,807,402 A 2/1989 Rai
4,828,582 A 5/1989 Frushour
4,844,185 A 7/1989 Newton, Jr. et al.
4,861,350 A 8/1989 Phaal et al.
4,871,377 A 10/1989 Frushour
4,899,922 A 2/1990 Slutz et al.
4,919,220 A 4/1990 Fuller et al.
4,940,180 A 7/1990 Martell
4,943,488 A 7/1990 Sung et al.
4,944,772 A 7/1990 Cho
4,976,324 A 12/1990 Tibbitts
4,985,051 A 1/1991 Ringwood
5,011,514 A 4/1991 Cho et al.
5,027,912 A 7/1991 Juergens
5,030,276 A 7/1991 Sung et al.
5,032,147 A 7/1991 Frushour
5,037,704 A 8/1991 Nakai et al.
5,092,687 A 3/1992 Hall
5,116,568 A 5/1992 Sung et al.
5,127,923 A 7/1992 Bunting et al.
5,135,061 A 8/1992 Newton, Jr.
5,176,720 A 1/1993 Martell et al.
5,186,725 A 2/1993 Martell et al.
5,199,832 A 4/1993 Meskin et al.
5,205,684 A 4/1993 Meskin et al.
5,213,248 A 5/1993 Horton et al.
5,238,074 A 8/1993 Tibbitts et al.
5,264,283 A 11/1993 Waldenstrom et al.
5,337,844 A 8/1994 Tibbitts
5,370,195 A 12/1994 Keshavan et al.
5,379,853 A 1/1995 Lockwood et al.
5,439,492 A 8/1995 Anthony et al.
5,464,068 A 11/1995 Najafi-Sani
5,468,268 A 11/1995 Tank et al.
5,496,638 A 3/1996 Waldenstrom et al.
5,505,748 A 4/1996 Tank et al.
5,510,193 A 4/1996 Cerutti et al.
5,523,121 A 6/1996 Anthony et al.
5,524,719 A 6/1996 Dennis
5,560,716 A 10/1996 Tank et al.
5,607,024 A 3/1997 Keith et al.
5,620,382 A 4/1997 Cho et al.
5,624,068 A 4/1997 Waldenstrom et al.
5,645,617 A 7/1997 Frushour
5,667,028 A 9/1997 Truax et al.
5,718,948 A 2/1998 Ederyd et al.
5,722,499 A 3/1998 Nguyen et al.
5,776,615 A 7/1998 Wong et al.
5,833,021 A 11/1998 Mensa-Wilmot et al.
5,875,862 A 3/1999 Jurewicz et al.
5,897,942 A 4/1999 Karner et al.
5,954,147 A 9/1999 Overstreet et al.
5,979,578 A 11/1999 Packer
6,009,963 A 1/2000 Chaves et al.
6,063,333 A 5/2000 Dennis
6,123,612 A 9/2000 Goers
6,126,741 A 10/2000 Jones et al.
6,193,001 B1 2/2001 Eyre et al.
6,234,261 B1 5/2001 Evans et al.
6,248,447 B1 6/2001 Griffin et al.
6,269,894 B1 8/2001 Griffin
6,302,225 B1 10/2001 Yoshida et al.
6,315,065 B1 11/2001 Yong et al.
6,344,149 B1 2/2002 Oles
6,410,085 B1 6/2002 Griffin et al.
6,435,058 B1 8/2002 Matthias et al.
6,443,248 B2 9/2002 Yong et al.
6,544,308 B2 4/2003 Griffin et al.
6,562,462 B2 5/2003 Griffin et al.
6,585,064 B2 7/2003 Griffin et al.
6,589,640 B2 7/2003 Griffin et al.
6,592,985 B2 7/2003 Griffin et al.
6,601,662 B2 8/2003 Matthias et al.
6,739,214 B2 5/2004 Griffin et al.
7,377,341 B2 5/2008 Middlemiss et al.
7,462,003 B2 12/2008 Middlemiss
2002/0023733 A1 2/2002 Hall
2002/0074168 A1 6/2002 Matthias et al.
2005/0050801 A1 3/2005 Cho et al.
2005/0129950 A1 6/2005 Griffin et al.
2005/0139397 A1 6/2005 Achilles
2005/0230156 A1 10/2005 Belnap et al.
2005/0263328 A1 12/2005 Middlemiss
2006/0165993 A1 7/2006 Keshavan
2006/0191723 A1 8/2006 Keshavan
2006/0217258 A1 9/2006 Zhao
2007/0079994 A1 4/2007 Middlemiss
2007/0151769 A1 7/2007 Slutz et al.
2007/0181348 A1 8/2007 Lancaster et al.
2007/0187155 A1 8/2007 Middlemiss
2008/0073126 A1 3/2008 Shen et al.
2008/0185189 A1 8/2008 Griffo et al.
2008/0223621 A1 9/2008 Middlemiss et al.
2008/0230280 A1 9/2008 Keshavan et al.
2009/0152017 A1 6/2009 Shen et al.

FOREIGN PATENT DOCUMENTS

EP 0196777 10/1986
EP 0196777 A1 10/1986
EP 0297071 12/1988
EP 0297071 A1 12/1988
EP 0300699 1/1989
EP 0329954 8/1989
EP 0329954 A2 8/1989
EP 0352811 1/1990
EP 0352811 A1 1/1990
EP 0374424 6/1990
EP 0374424 A1 6/1990
EP 0500253 8/1992
EP 0585631 3/1994
EP 0595630 5/1994
EP 0612868 8/1994
EP 0612868 A1 8/1994
EP 0617207 9/1994
EP 0617207 A2 9/1994
EP 0787820 8/1997
EP 0860515 8/1998
EP 1116858 A1 7/2001
EP 1190791 3/2002
EP 1190791 A2 3/2002
EP 1760165 A2 3/2007
GB 1349385 4/1974
GB 1349385 A 4/1974
GB 2048927 12/1980
GB 2261894 6/1993
GB 2268768 1/1994
GB 2270493 A 3/1994
GB 2323398 9/1998
GB 2408735 A 6/2005
GB 2 408 735 8/2005

| | | | |
|---|---|---|---|
| GB | 2 413 813 | | 9/2005 |
| GB | 2413813 | A | 11/2005 |
| GB | 2427215 | A | 12/2006 |
| GB | 2429471 | A | 2/2007 |
| GB | 2431948 | A | 5/2007 |
| GB | 2453023 | | 3/2009 |
| GB | 2453023 | A | 3/2009 |
| GB | 2453435 | A | 4/2009 |
| JP | 59219500 | | 12/1984 |
| JP | 8176696 | | 7/1996 |
| JP | 8176696 | A | 7/1996 |
| RU | 2034937 | | 5/1995 |
| RU | 2034937 | C1 | 5/1995 |
| RU | 566439 | | 1/2000 |
| SU | 990486 | | 1/1983 |
| WO | 9323204 | | 11/1993 |
| WO | 9323204 | A1 | 11/1993 |
| WO | 9634131 | | 10/1996 |
| WO | 0028106 | | 5/2000 |
| WO | 0028106 | A1 | 5/2000 |
| WO | 2004040095 | | 5/2004 |
| WO | 2004106003 | | 12/2004 |
| WO | 2004106004 | | 12/2004 |
| WO | 2007042920 | | 4/2007 |
| WO | 2007042920 | A1 | 4/2007 |

OTHER PUBLICATIONS http://www.corrosionsource.come/handbook.periodic/periodic_tale.gif "Periodic Table of the elements".*

UK Intellectual Property Office, Search Report for British Patent Application No. GB 08 18022.6, Dec. 1, 2008, total 3 pages.

Translation of Japanese Unexamined Patent Application No. S59-219500. "Diamond Sintering and Processing Method," Shuji Yatsu and Tetsuo Nakai, inventors; Application published Dec. 10, 1984; Applicant: Sumitomo Electric Industries Co. Ltd. Office Action by USPTO mailed Mar. 11, 2003 for related U.S. Appl. No. 10/065,604. Search Report issued in United Kingdom application No. GB0818022.6 dated Dec. 1, 2008. (3 pages).

* cited by examiner

DIAMOND-BONDED CONSTRUCTIONS WITH IMPROVED THERMAL AND MECHANICAL PROPERTIES

FIELD OF THE INVENTION

This invention generally relates to diamond-bonded constructions and, more specifically, to polycrystalline diamond-containing constructions and compacts formed therefrom that are specially engineered to provide improved thermal and mechanical properties when compared to conventional polycrystalline diamond materials.

BACKGROUND OF THE INVENTION

Polycrystalline diamond (PCD) materials and PCD elements formed therefrom are well known in the art. Conventional PCD is formed subjecting diamond grains in the presence of a suitable solvent catalyst material to processing conditions of extremely high pressure/high temperature (HPHT), where the solvent catalyst material promotes desired intercrystalline diamond-to-diamond bonding between the grains, thereby forming a PCD structure. The resulting PCD structure produces enhanced properties of wear resistance and hardness, making such PCD materials extremely useful in aggressive wear and cutting applications where high levels of wear resistance and hardness are desired.

Solvent catalyst materials typically used for forming conventional PCD include metals from Group VIII of the Periodic table, with Cobalt (Co) being the most common. Conventional PCD can comprise from 85 to 95% by volume diamond and a remaining amount of the solvent catalyst material. The solvent catalyst material is present in the microstructure of the PCD material within interstitial regions that exist between the bonded-together diamond grains.

A problem known to exist with such conventional PCD is thermal degradation due to differential thermal expansion characteristics between the interstitial solvent catalyst material used to sinter the PCD and the intercrystalline bonded diamond. Such differential thermal expansion is known to occur at temperatures of about 400° C., causing ruptures to occur in the diamond-to-diamond bonding, and resulting in the formation of cracks and chips in the PCD structure.

Another problem known to exist with conventional PCD materials is also related to the presence of the solvent catalyst material used to sinter the PCD in the interstitial regions and the adherence of the solvent catalyst to the diamond crystals to cause another form of thermal degradation. Specifically, the solvent catalyst material is known to cause an undesired catalyzed phase transformation in diamond (converting it to carbon monoxide, carbon dioxide, or graphite) with increasing temperature, thereby limiting practical use of conventional PCD to about 750° C.

Attempts at addressing such unwanted forms of thermal degradation in PCD are known in the art. Generally, these attempts have involved forming a PCD body having an improved degree of thermal stability when compared to those conventional PCD materials discussed above. One known technique of producing a thermally stable PCD body involves at least a two-stage process of first forming a conventional sintered PCD body in the manner described above, and then removing the solvent catalyst material therefrom.

This method produces a diamond-bonded body that is substantially free of the solvent catalyst material, and is therefore promoted as providing a diamond-bonded body having improved thermal stability when compared to conventional PCD. However, the resulting thermally stable diamond-bonded body typically does not include a metallic substrate attached thereto, by solvent catalyst infiltration from such substrate due to the solvent catalyst removal process, as all of the solvent catalyst material has been removed therefrom.

Also, the resulting diamond body has a material microstructure comprising a matrix phase of bonded-together diamond grains, and a plurality of open interstitial regions, pores or voids distributed throughout the diamond body. The presence of such population of open voids throughout the diamond body adversely impacts desired mechanical properties of the diamond body, e.g., provides a diamond body having reduced properties of strength and toughness when compared to conventional PCD. It is theorized that the presence of the catalyst material within the voids in conventional PCD operates to place the surrounding diamond matrix in a state of compression that operates to provide improved mechanical strength, e.g., fracture toughness and/or impact strength, to the PCD. Removing the catalyst material from the diamond body is thus believed to remove the diamond from a compression state, thereby also reducing the above-noted related mechanical properties of the diamond body.

Thus, thermally stable diamond-bonded bodies made by removing the solvent catalyst material therefrom are known to be relatively brittle and have poor properties of strength and/or toughness, thereby limiting their use to less extreme or severe applications. This feature makes such conventional thermally stable diamond-bonded bodies generally unsuited for use in aggressive cutting and/or wear applications, such as use as a cutting element of a subterranean drilling and the like.

The resulting diamond-bonded body, rendered free of the solvent catalyst material, has a coefficient of thermal expansion that is sufficiently different from that of conventional substrate materials (such as WC—Co and the like) typically infiltrated or otherwise attached to conventional PCD bodies to provide a diamond-bonded compact to adopt the diamond-bonded body construction for use with desirable wear and/or cutting end use devices. This difference in thermal expansion between the now thermally stable diamond-bonded body and the substrate, combined with the poor wettability of the diamond-bonded body surface due to the removal of the solvent catalyst material, makes it very difficult to form an adequate attachment between the diamond-bonded body and conventionally used substrates, thereby requiring that the diamond-bonded body itself be attached or mounted directly to the wear and/or cutting device.

However, since such thermally stable diamond-bonded body is devoid of a metallic substrate, it cannot (e.g., when configured for use as a cutting element in a bit used for subterranean drilling) be attached to such drill bit by conventional brazing process. Thus, use of such thermally stable diamond-bonded body in this particular application necessitates that the diamond-bonded body itself be attached to the drill bit by mechanical or interference fit during manufacturing of the drill bit, which is labor intensive, time consuming, and which does not provide a most secure method of attachment.

Other attempts that have been made to improve the thermal stability of PCD materials include where the solvent metal catalyst material used to form the PCD is removed from only a region of the body, i.e., where the solvent metal catalyst is removed from a defined region of the diamond body that extends a depth from the body surface. Such diamond body constructions are formed by starting with conventional PCD, and then selectively removing the solvent metal catalyst from only a region of the body extending a depth from the body surface, wherein a remaining portion of the diamond body comprises conventional PCD. While this approach has demonstrated some improvement in thermal stability over conventional PCD, the resulting diamond body still suffers from the problems noted above. Namely, that the treated region rendered devoid of the catalyst material has reduced mechanical properties of strength and/or toughness when compared to conventional PCD, due to the absence of the catalyst material and the related presence of the plurality of empty pores or voids in the interstitial regions.

It is, therefore, desired that a diamond-bonded construction be developed having improved thermal characteristics and thermal stability when compared to conventional PCD materials. It is also desired that such diamond-bonded construction be engineered to include a suitable substrate to form a compact construction that can be attached to a desired wear and/or cutting device by conventional method such as welding or brazing and the like. It is further desired that such diamond-bonded construction display desired mechanical properties such as strength and toughness when compared to conventional thermally stable diamond-bonded bodies, i.e., characterized by having a plurality of empty interstitial regions formed by removing the catalyst material therefrom.

SUMMARY OF THE INVENTION

Diamond-bonded constructions of this invention include a diamond-bonded body comprising a thermally stable region that extends a distance below a diamond-bonded body surface. The thermally stable region has a material microstructure comprising a matrix first phase of bonded-together diamond crystals, and a plurality of second phases interposed within the matrix first phase. The plurality of second phases comprises a material that is a reaction product formed between a reactive material and the diamond crystals at high pressure/high temperature (HPHT) conditions. In a preferred embodiment, the reactive material is a carbide former, e.g., titanium, and the reaction product is a carbide, e.g., titanium carbide. In an example embodiment, the plurality of second phases occupy voids that previously existed within the interstitial regions of the material microstructure and that were formed by removing a catalyst material therefrom. The second phase may or may not occupy all of the voids in the thermally stable region.

In an example embodiment, the thermally stable region is substantially free of the solvent catalyst material that was used to initially sinter the diamond grains together during a first HPHT process to form the diamond-bonded body. Further, the reaction product formed between the material used to fill the voids and the diamond grains preferably has one or more thermal characteristics that more closely match the bonded-together diamond crystals then those of the catalyst material that was removed from the thermally stable region. Additionally, it is desired that the reaction product operate to elevate the graphitization temperature of the thermally-stable region when compared to the graphitization temperature of such region as previously occupied with the catalyst material.

In an example embodiment, the thermally stable region is formed by first removing the catalyst material used to form the diamond-bonded body therefrom, and then filling all or a portion of the resulting empty voids or pores through the use of an infiltrant material comprising the reactant that infiltrates into pores previously occupied by the catalyst material. In an example embodiment, the infiltrant material comprising the reactant also includes one or more other materials, such as an alloy material or the like, for the purpose of facilitating the desired infiltration of the reactive material, and/or reducing the melting temperature of the reactive material to facilitate infiltration at a temperature that is below that of the catalyst material, and/or that controls the rate of reaction between the reactant and the diamond crystals. In an example embodiment, the reactive material is Ti and the other materials useful for in combining with the reactant can be one or more metal selected from Group VIII of the Periodic table, such as nickel or the like.

The diamond-bonded body farther includes a diamond-bonded region that extends a depth from the thermally stable region and has a material microstructure comprising a diamond-bonded matrix phase and a material disposed within interstitial regions of the matrix phase. The material disposed within the interstitial regions of this further region may be the catalyst material or may be a material, e.g., a Group VIII metal, that is not the catalyst material, e.g., that is subsequently infiltrated into such further region after the diamond-bonded body has been initially sintered. The construction can include a substrate that is attached to the diamond-bonded body.

The construction may further include a material layer disposed along at least a portion of a surface of the thermally stable diamond-bonded region. The material layer is preferably formed from the reaction product and may be positioned to form at least a portion of the working surface of the construction.

The thermally stable region of the diamond-bonded body is prepared by treating the diamond-bonded body, comprising bonded-together diamond crystals and a catalyst material used to initially form the same disposed interstitially between the diamond crystals, to remove at least a portion of the catalyst material therefrom. Thus, the resulting treated diamond-bonded body may comprise a region substantially free of the catalyst material and thus be thermally stable, and an untreated region that comprises the catalyst material. Alternatively, the entire diamond-bonded body can be treated to render it substantially free of the catalyst material, thus be thermally stable.

An infiltrant material comprising the reactive material is placed in contact with the region of the diamond-bonded body removed of the catalyst material, and the diamond-bonded body and the reactive material are subjected to a HPHT process to cause the reactive material to infiltrate into the region of the diamond-bonded body and fill at least a portion or population of the voids created by removal of the catalyst material. During or after such HPHT process, the reactive material reacts with the diamond crystals in the region to thereby form the desired reaction product that occupies the plurality interstitial regions forming second phases within the material microstructure. The use of the HPHT process operates to both enhance the infiltration characteristics of the infiltrant material to thereby to ensure a desired degree of infiltration into the desired diamond body region, and to avoid degradation of the diamond material in the diamond body by staying in the diamond-stable region of the phase diagram.

In the event that the catalyst material is removed from the entire diamond-bonded body, another infiltrant material, e.g., a Group VIII metal, is positioned adjacent a further region of the diamond-bonded body and the diamond-bonded body and the other infiltrant material is subjected to a HPHT process to melt the other infiltrant and cause it to enter the body and fill the voids in the further region. In an example embodiment, the source of such other infiltrant is a substrate, e.g., a WC—Co substrate, and the process of melting the other infiltrant can take place during the same HPHT process as noted above for the infiltrant comprising the reactive material, at a higher temperature.

Diamond-bonded constructions of this invention display improved thermal characteristics and thermal stability when compared to conventional PCD materials, and improved mechanical properties of fracture toughness and impact strength when compared to conventional thermally stable PCD formed by simply removing and not replacing the catalyst material removed therefrom. The benefit in mechanical properties over conventional thermally stable PCD materials is gained by retaining a desired degree of beneficial compressive stress in the thermally stable region that is provided by the infiltrant material and resulting reaction product. Further, diamond-bonded constructions of this invention facilitate attachment with a suitable substrate to form a compact construction that can be attached to a desired wear and/or cutting device by conventional methods such as welding or brazing and the like.

BRIEF DESCRIPTION OF THE DRAWINGS

These and other features and advantages of the present invention will be appreciated as the same becomes better understood by reference to the following detailed description when considered in connection with the accompanying drawings wherein.

DETAILED DESCRIPTION

Figure 1:
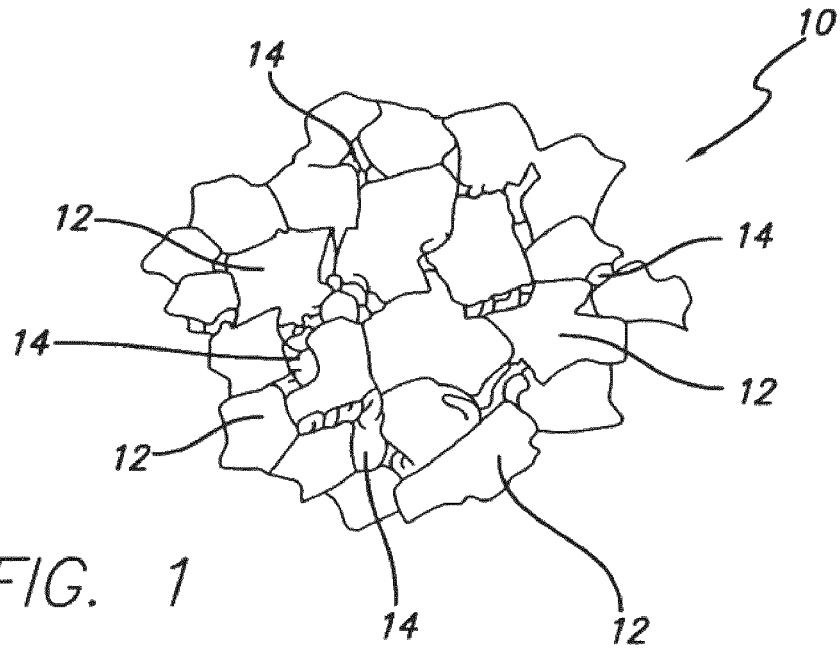
FIG. 1 is schematic microstructural view taken of a thermally stable region of a diamond-bonded construction of this invention.

Diamond-bonded constructions of this invention are specifically engineered having a diamond-bonded body that includes a diamond-bonded region that includes a Group VIII material from the Periodic table disposed interstitially between the bonded-together diamond crystals, wherein the Group VIII material may or may not be the catalyst material that was used to sinter the diamond-bonded body by HPHT process, and a diamond-bonded region that is substantially free of the Group VIII material and that includes a reaction product formed between the diamond within this region and a reactive material. Diamond-bonded constructions of this invention may further include a layer of material disposed above a surface of the diamond-bonded body that is formed from the reaction product and/or the infiltrant material. Diamond-bonded constructions of this invention provide desired improvement in thermal characteristics and thermal stability or resistance, when compared to conventional PCD materials, while at the same time providing a desired degree of strength and fracture toughness and/or impact resistance, while compared to conventional thermally stable diamond constructions formed by simply removing the catalyst material therefrom and comprising a plurality of empty pores in the resulting material microstructure.

As used herein, the term "PCD" is used to refer to polycrystalline diamond that has been formed, at high pressure/high temperature (HPHT) conditions, through the use of a metal solvent catalyst, such as those metals included in Group VIII of the Periodic table, that remains within the material microstructure. The diamond-bonded region that includes the reaction product is not referred to as being PCD because it does not include the catalyst material that was used to initially sinter the diamond body. Further, the diamond-bonded region that includes the reaction product is unlike conventional thermally stable diamond-bonded materials because it does not include the plurality of unfilled interstitial voids or pores resulting from the removal of the catalyst material therefrom.

In one example embodiment, the diamond-bonded body includes, in addition to the diamond-bonded region substantially free of the catalyst material, a region comprising conventional PCD that include the catalyst material that was used to sinter the diamond body, and an optional layer or region of material disposed over a surface of the diamond-bonded region substantially free of the catalyst material.

In another example embodiment, the diamond-bonded body includes, in addition to the diamond-bonded region substantially free of the catalyst material, a region comprising conventional the diamond-bonded crystals and a Group VIII material from the Periodic table that was not used to sinter the diamond body, and an optional layer or region of material disposed over a surface of the diamond-bonded region substantially free of the catalyst material.

The presence of the PCD region or diamond-bonded region including the Group VIII material that was not used to sinter the diamond body, and/or the layer of material disposed over the diamond-bonded region substantially free of the catalyst material assists in imparting desired properties of hardness/toughness and impact strength to the diamond body that are otherwise lacking in conventional thermally stable diamond-bonded materials that have been rendered thermally stable by having substantially all of the solvent catalyst material removed therefrom and not replaced. The presence such a PCD region, or diamond-bonded region including the Group VIII material not used to sinter the diamond body, in the diamond-bonded body also allows diamond-bonded constructions of this invention to be permanently joined to a desired substrate, thereby facilitating attachment of the resulting diamond-bonded compact to a desired end use cutting and/or wear and/or machining device, e.g., a bit used for drilling subterranean formations, by conventional means such as by brazing, welding and the like.

In an example embodiment, diamond-bonded constructions of this invention are made by treating a PCD body or compact to remove the catalyst material that was used to sinter the same during HPHT processing from a region thereof, and then filling the region removed of the catalyst material with a replacement or infiltrant material. When starting with a preformed PCD compact, the diamond-bonded constructions of this invention can be formed using a single HPHT process, and when starting without a preformed PCD compact, diamond-bonded constructions of this invention can be formed using two HPHT processes; namely, a first HPHT process to form the PCD compact, and a second HPHT process to form the desired diamond-bonded construction.

FIG. 1 illustrates a region of a diamond-bonded construction 10 of this invention that is substantially free of the catalyst material that was used to initially sinter the diamond body, and that has a resulting material microstructure comprising a polycrystalline diamond matrix first phase 12 including a plurality of bonded-together diamond crystals formed at HPHT conditions. A plurality of second phases 14 are disposed interstitially between the bonded together diamond crystals and comprises a reaction product formed by the reaction of the diamond in the first phase with a desired reactive material. In a preferred embodiment, the reaction product operates both to partially or completely fill the voids or pores left in the interstitial regions caused by the removal of the catalyst material, and impose a desired compressive stress onto the surrounding polycrystalline diamond matrix phase.

As described in greater detail below, the material selected to form the second phases within this particular diamond-body region is preferably one that includes a reactive material useful for forming a reaction product with the bonded-together diamond grains in this region. A feature of the second regions is that they do not include or are substantially free of the catalyst material that was initially used to sinter the polycrystalline diamond matrix phase. As used herein, the term "catalyst material" is understood to refer to those materials that were initially used to sinter the PCD material, i.e., to facilitate the bonding together of the diamond crystals in the diamond body at HPHT conditions, and does not include materials that may be added subsequent to the sintering of the diamond body, e.g., in the form of an infiltrant or the components of the infiltrant such as an alloying agent and a reactive material, to form the second phases.

Additionally, it is desired that the infiltrant material used to form the second phases comprise a reactive material that is capable of reacting with the polycrystalline diamond matrix to form a reaction product therewith. The infiltrant material can comprise one or more reactive materials and/or may comprise a combination of a reactive materials with one or more nonreactive materials. As noted above, in an example embodiment, the infiltrant material used to fill the second phases is provided in the form of an alloy comprising a reactive material and another material that facilitates infiltration and/or that reduces the temperature needed to achieve desired infiltration during HPHT processing. The presence of such reaction product within the diamond body may be desired in certain applications calling for an enhanced degree of mechanical strength, e.g., strength and/or toughness, within the particular diamond-bonded region substantially free or devoid of the catalyst material. Further, the infiltrant material can be one that is selected to shift upwardly the graphitization temperature of the resulting diamond region containing the same, thereby operating to improve the thermal stability of the diamond construction.

Accordingly, referring still to FIG. 1, the material microstructure of this diamond-bonded region devoid of the catalyst material comprises a first matrix phase of bonded-together diamond grains 12, and a plurality of second phases 14 disposed within interstitial regions of the matrix. The reaction product is formed within the second phases between a reactive material and the diamond grains. In a preferred embodiment, the reaction product fills all or a significant population of the of voids or pores resulting from the removal of the catalyst material.

Diamond grains useful for forming the diamond-bonded body during the HPHT process include diamond powders having an average diameter grain size in the range of from submicrometer in size to 0.1 mm, and more preferably in the range of from about 0.001 mm to 0.08 mm. The diamond powder can contain grains having a mono or multi-modal size distribution. For example, the diamond powder can comprise a multimodal distribution of diamond grains comprising about 80 percent by volume diamond grains sized 20 to 30 micro-meters, and 20 percent by volume diamond grains sized 1 to 6 micrometers. In a preferred embodiment for a particular application, the diamond powder has an average particle grain size of from about 5 to 30 micrometers. However, it is to be understood that the diamond grains having a grain size greater than this amount, e.g., greater than about 30 micrometers, can be used for certain drilling and/or cutting applications. In the event that diamond powders are used having differently sized grains, the diamond grains are mixed together by conventional process, such as by ball or attrittor milling for as much time as necessary to ensure good uniform distribution.

The diamond powder used to prepare the diamond-bonded body can be synthetic diamond powder. Synthetic diamond powder is known to include small amounts of solvent metal catalyst material and other materials entrained within the diamond crystals themselves. Alternatively, the diamond powder used to prepare the diamond-bonded body can be natural diamond powder. The diamond grain powder, whether synthetic or natural, can be combined with a desired amount of solvent catalyst to facilitate desired intercrystalline diamond bonding during HPHT processing.

Suitable catalyst materials useful for forming the PCD body include metal solvent catalysts selected from Group VIII of the Periodic table, with Cobalt (Co) being the most common, and mixtures or alloys of two or more of these materials. The diamond grain powder and catalyst material mixture can comprise 85 to 95% by volume diamond grain powder and the remaining amount catalyst material. In certain applications, the mixture can comprise greater than 95% by volume diamond grain powder. Alternatively, the diamond grain powder can be used without adding a solvent metal catalyst in applications where the solvent metal catalyst is provided by infiltration during HPHT processing from a substrate positioned adjacent the diamond powder volume.

In certain applications it may be desired to have a diamond-bonded body comprising a single diamond-containing volume or region, while in other applications it may be desired that a diamond-bonded body be constructed having two or more different diamond-containing volumes or regions. For example, it may be desired that the diamond-bonded body include a first diamond-containing region extending a distance from a working surface, and a second diamond-containing region extending from the first diamond-containing region to the substrate. Such diamond-containing regions can be engineered having different diamond volume contents and/or be engineered having differently sized diamond grains. It is, therefore, understood that thermally stable diamond-bonded constructions of this invention may include one or multiple regions comprising different diamond densities and/or diamond grain sizes as called for by a particular cutting and/or wear end use application.

In an example embodiment, the diamond grain powder is preferably cleaned, and loaded into a desired container adjacent a desired substrate for placement within a suitable HPHT consolidation and sintering device. An advantage of combining a substrate with the diamond powder volume prior to HPHT processing is that the resulting compact includes the substrate bonded thereto to facilitate eventual attachment of the compact to a desired wear and/or cutting device by conventional method, e.g., by brazing or welding or the like. In an example embodiment, the substrate includes a metal solvent catalyst for catalyzing intercrystalline bonding of the diamond grains by infiltration during the HPHT process.

Suitable materials useful as substrates include those materials used as substrates for conventional PCD compacts, such as those formed from ceramic materials, metallic materials, cermet materials, carbides, nitrides, and mixtures thereof. In a preferred embodiment, the substrate is provided in a preformed state and includes a metal solvent catalyst capable of infiltrating into the adjacent diamond powder mixture during HPHT processing used to initially form the PCD body to facilitate sintering and providing a bonded attachment with the resulting sintered body. Alternatively, the substrate can be provided in the form of a green state, i.e., unsintered, part, or can be provided in the form of a powder volume. It is desired that the metal solvent catalyst disposed within the substrate be one that melts at a temperature above the temperature used during the subsequent process of process of introducing the infiltrant material into the designated diamond body region and reacting the reactive material therein to form the desired reaction product. Suitable metal solvent catalyst materials include those selected from Group VIII elements of the Periodic table. A preferred metal solvent catalyst is Cobalt (Co), and a preferred substrate material comprises cemented tungsten carbide (WC—Co).

The HPHT device is activated to subject the container and its contents to a desired HPHT condition to consolidate and sinter the diamond powder mixture to form PCD. In an example embodiment, the device is controlled so that the container is subjected to a HPHT condition comprising a pressure in the range of from 5 to 7 GPa and a temperature in the range of from about 1,320 to 1,600° C., for a sufficient period of time. During this HPHT process, the catalyst material present in the substrate melts and infiltrates the diamond grain powder to facilitate intercrystalline diamond bonding and bonding of the resulting diamond-bonded body to the substrate. During formation of the diamond-bonded body, the catalyst material migrates into interstitial regions within the diamond-bonded body disposed between the diamond-bonded grains.

Figure 2A:
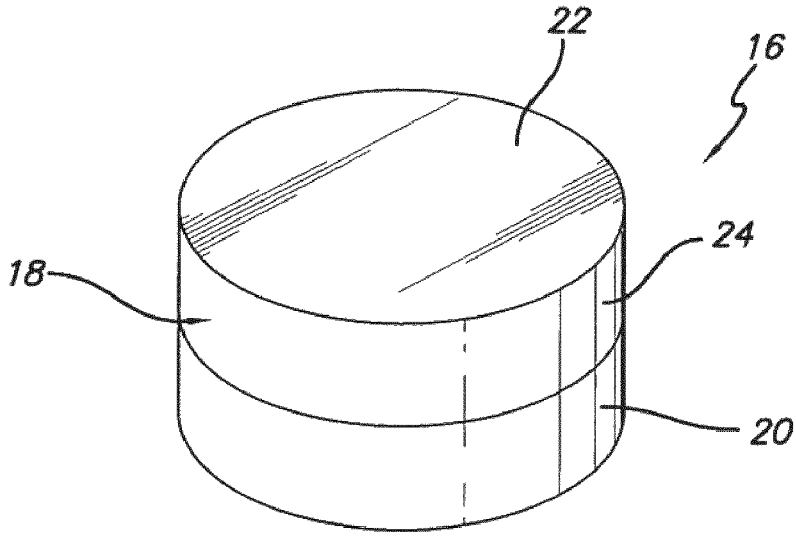
FIGS. 2A to 2E are perspective views of different compact embodiments comprising diamond-bonded constructions of this invention.
Figure 2B:
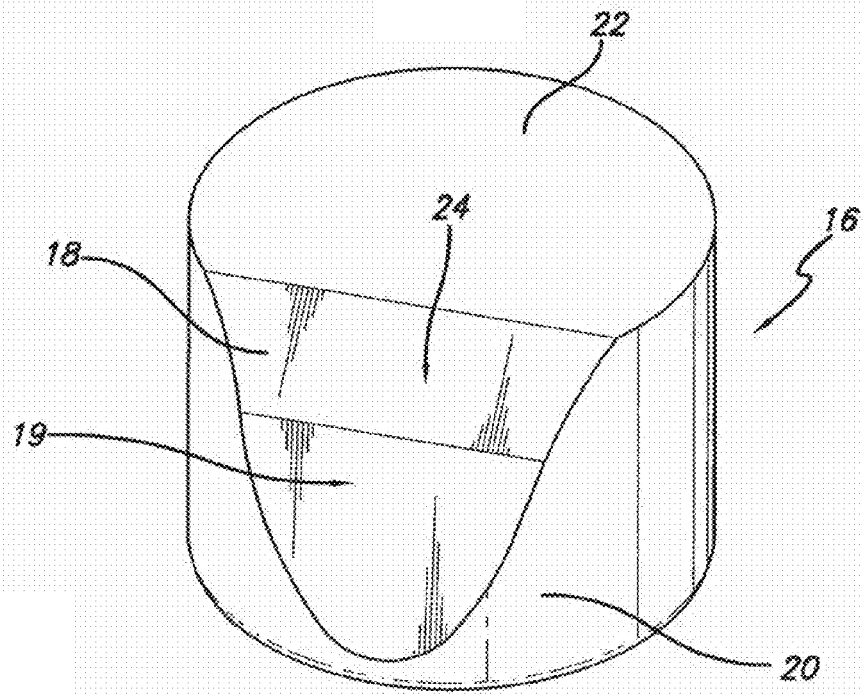
Figure 2C:
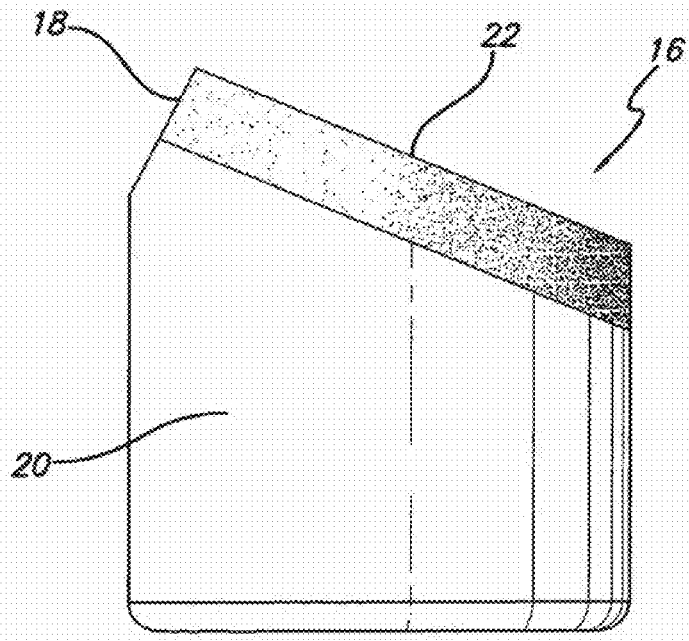
Figure 2D:
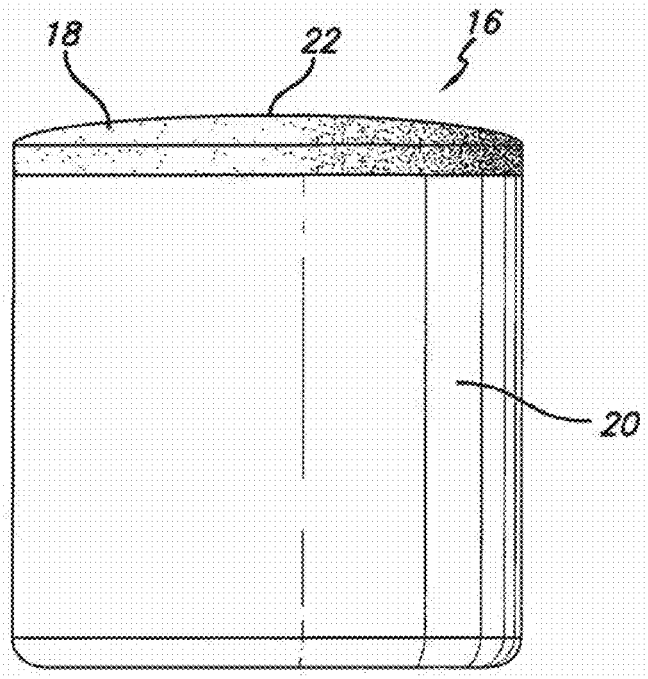
Figure 2E:
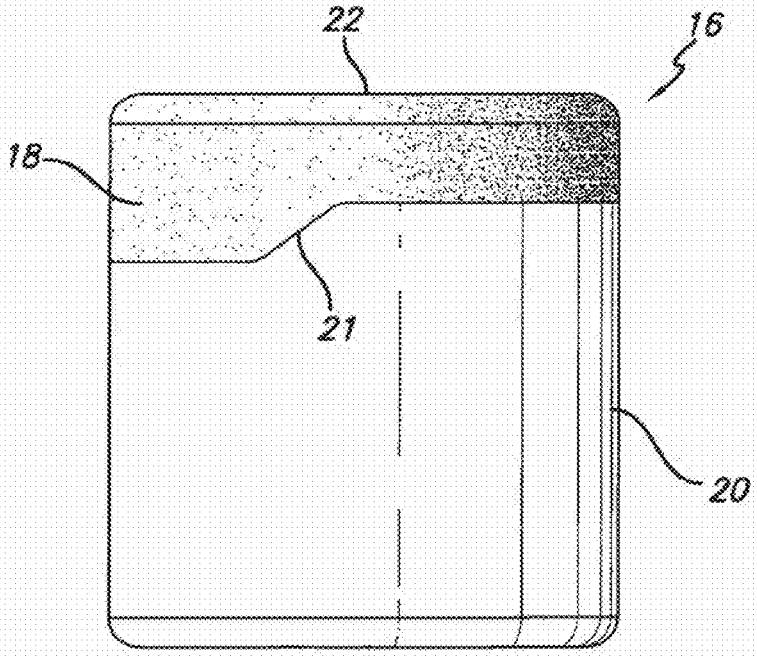

FIG. 2A illustrates a PCD compact 16 formed according to this process comprising a diamond-bonded body 18 formed from PCD and a substrate 20 attached thereto. The diamond body includes a working surface 22 positioned along a desired outside surface portion of the diamond body 18. In the example embodiment illustrated in FIG. 2A, the diamond body and substrate are each configured in the form of generally cylindrical members, and the working surface is positioned along an axial end across a diamond table of the diamond body 18.

It is to be understood that PCD compacts useful for forming diamond-bonded constructions of this invention can be configured differently, e.g., having a diamond body mounted differently on the substrate and/or having a working surface positioned differently along the diamond body and/or differently relative to the substrate. FIGS. 2B to 2E illustrate PCD compact embodiments that are configured differently than that illustrated in FIG. 2A for purposes of reference, and that are all useful for forming diamond-bonded constructions of this invention.

In an example embodiment, once formed, the diamond-bonded body 18 is treated to remove the catalyst material used to initially sinter and form the diamond-bonded body from a selected region thereof. This can be done, for example, by removing substantially all of the catalyst material from the selected region by suitable process, e.g., by acid leaching, aqua regia bath, electrolytic process, chemical processes, electrochemical processes or combinations thereof.

It is desired that the selected region where the catalyst material is removed, or the region of the diamond-bonded body that is devoid or substantially free of the catalyst material, be one that extends a determined depth from a surface of the diamond-bonded body independent of the diamond-bonded body orientation. Again, it is to be understood that the surface from which the catalyst material is removed may include more than one surface portion of the diamond-bonded body. In an example embodiment, it is desired that the region rendered substantially free of the catalyst material extend from a surface of the diamond-bonded body an average depth of at least about 0.005 mm. The exact depth of this region is understood to vary depending on such factors as the diamond density, the diamond grain size, and the ultimate end use application.

In an example embodiment, the region can extend from the surface of the diamond body to an average depth that can be less than about 0.1 mm for certain applications, or that can be greater than about 0.1 mm for other applications. In an example embodiment, the region that is rendered substantially free of the catalyst material extends from the surface of the diamond-bonded body an average depth of from about 0.02 mm to about 0.09 mm, and more preferably from about 0.04 mm to about 0.08 mm. As noted above, for more aggressive tooling, cutting and/or wear applications, the region rendered substantially free of the catalyst material can extend a depth from the working surface of greater than about 0.1 mm, e.g., up to 0.2 mm or 0.3 mm.

The diamond-bonded body can be machined, e.g., by OD grinding and/or polishing, to its approximate final dimension prior to treatment. Alternatively, the diamond-PCD compact can be treated first and then machined to its final dimension. The targeted region for removing the catalyst material can include any surface region of the body, including, and not limited to, the diamond table, a beveled section extending around and defining a circumferential edge of the diamond table, and/or a sidewall portion extending axially a distance away from the diamond table towards or to the substrate interface. In a preferred embodiment, the diamond bonded body is machined finished to its approximate final dimension prior to treatment, which may or may not include the formation of a beveled section as noted above.

It is to be understood that the depth of the region removed of the catalyst material is represented as being a nominal or average value, e.g., arrived at by taking a number of measurements at preselected intervals along this region and then determining the average value for al of the points. The remaining/untreated region of the diamond-bonded body is understood to still contain the catalyst material and comprises PCD.

Additionally, when the diamond-bonded body is treated, it is desired that the selected depth of the region to be rendered substantially free of the catalyst material be one that allows a sufficient depth of remaining PCD so as to not adversely impact the attachment or bond formed between the diamond-bonded body and the substrate. In an example embodiment, it is desired that the untreated or remaining PCD region within the diamond-bonded body have a thickness of at least about 0.01 mm as measured from the substrate. It is, however, understood that the exact thickness of the PCD region can and will vary from this amount depending on such factors as the size and configuration of the diamond-bonded construction, and the particular diamond-bonded construction end-use application.

In an example embodiment, the selected region of the diamond-bonded body to be removed of the catalyst material is treated by exposing the desired surface or surfaces of the diamond-bonded body to acid leaching, as disclosed for example in U.S. Pat. No. 4,224,380, which is incorporated herein by reference. Generally, after the diamond-bonded body or compact is made by HPHT process, the identified body surface or surfaces, are placed into contact with the acid leaching agent for a sufficient period of time to produce the desired leaching or catalyst material depletion depth.

Suitable leaching agents for treating the selected region include materials selected from the group consisting of inorganic acids, organic acids, mixtures and derivatives thereof. The particular leaching agent that is selected can depend on such factors as the type of catalyst material used, and the type of other non-diamond metallic materials that may be present in the diamond-bonded body. In an example embodiment, suitable leaching agents include hydrofluoric acid (HF), hydrochloric acid (HCl), nitric acid ($HNO_3$), and mixtures thereof.

In an example embodiment, where the diamond body to be treated is in the form of a diamond-bonded compact, the compact is prepared for treatment by protecting the substrate surface and other portions of the diamond-bonded body adjacent the desired treated region from contact (liquid or vapor) with the leaching agent. Methods of protecting the substrate surface include covering, coating or encapsulating the substrate and portion of PCD body with a suitable barrier member or material such as wax, plastic or the like.

Figure 3:
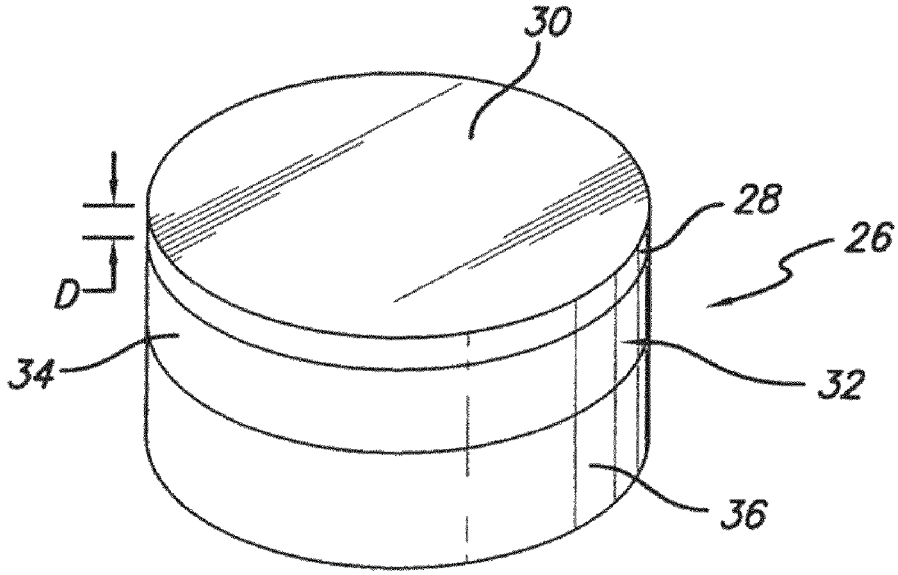
FIG. 3 is a perspective view of a diamond-bonded construction of this invention after a process step where a catalyst material has been removed from a region of the construction.
Figure 4:
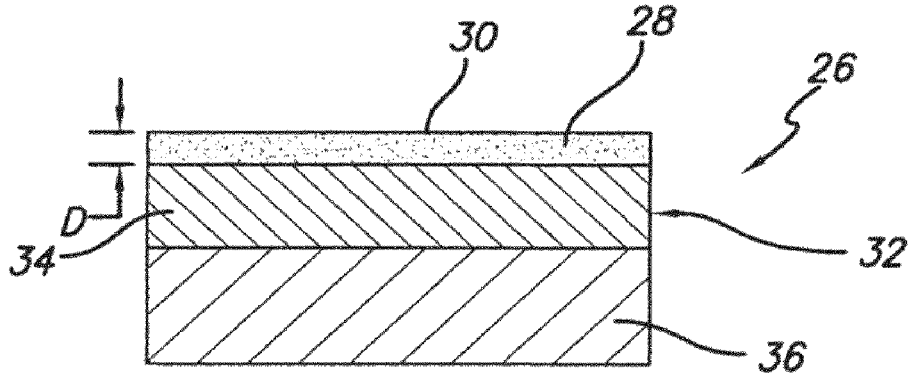
FIG. 4 is a cross-sectional side view of the construction of FIG. 3.

FIGS. 3 and 4 illustrate example embodiments of the diamond-bonded constructions 26 of this invention after the catalyst material has been removed from a selected region. The construction 26 comprises a treated region 28 that extends a selected depth "D" from a surface 30 of the diamond-bonded body 32. The remaining region 34 of the diamond-bonded body 32, extending from the treated region 28 to the substrate 36, comprises PCD having the catalyst material intact. As discussed above, the exact depth of the treated region having the catalyst material removed therefrom can and will vary.

Additionally, as mentioned briefly above, it is to be understood that the diamond-bonded constructions described above and illustrated in FIGS. 3 and 4 are representative of a single embodiment of this invention for purposes of reference, and that diamond-bonded constructions other than that specifically described and illustrated are understood to be within the scope of this invention. For example, diamond-bonded constructions comprising a diamond body having a treated region and then two or more other regions are possible, wherein a region interposed between the treated region and the region adjacent the substrate may be a transition region having a different diamond density and/or formed from diamond grains sized differently from that of the other diamond-containing regions.

Figure 5:
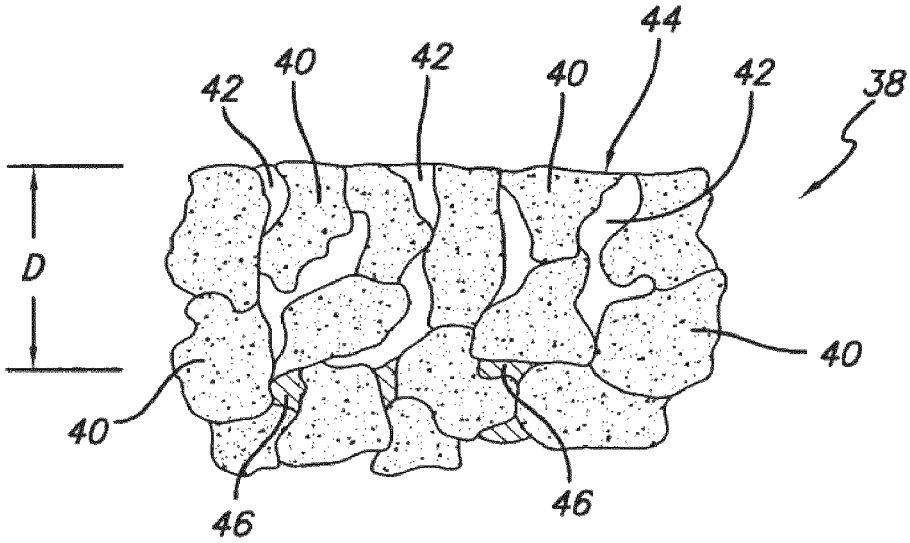
FIG. 5 is a schematic microstructural view taken of a section of the diamond-bonded construction where the catalyst material has been partially removed therefrom.

FIG. 5 illustrates the material microstructure 38 of the diamond-bonded constructions of this invention and, more specifically, the material microstructure taken from a section of the treated region. The treated region comprises a matrix phase of intercrystalline bonded diamond formed from a plurality of bonded-together diamond grains 40. The treated region also includes a plurality of interstitial regions 42 interposed between the diamond grains or crystals that are now substantially free of the catalyst material, i.e., that are now voids or empty pores. The treated region is shown to extend a distance "D" from a surface 44 of the diamond-boded body, wherein the interstitial regions 42 below the depth D are understood to include the catalyst material.

In one example embodiment, once the catalyst material is removed from the targeted region, the resulting diamond-bonded body is further processed to introduce an infiltrant material that includes a reactive material, to effect a desired reaction between the reactive material and the diamond in the targeted region and to optionally provide a layer of the reactive material and/or reactant product on a surface of the diamond body.

The infiltrant material includes one or more reactive materials, and can comprise other nonreactive materials, e.g., be provided in the form of an alloy or of a reactive material and another material that does not react with the diamond crystals. In a preferred embodiment, the infiltrant material is selected from a combination of one or more reactive materials with one or more nonreactive materials that when combined has a melting temperature below that of the catalyst material used to form the diamond-bonded body and that still exists in the PCD region of the diamond-bonded body. In a preferred embodiment, the infiltrant material includes a nonreactive material that also aids in the process of infiltrating the reactive material into the diamond body. In an example embodiment, the nonreactive material is selected to control the rate of reaction between the reactive material and the diamond during the process of infiltration to thereby improve the degree of infiltration into the diamond region by the infiltrant material.

Example nonreactive materials useful for forming the infiltrant material can include one or more metals selected from Group VIII of the CAS version of the Periodic table, such as Co, Ni and/or Fe. It is desired that the amount of the nonreactive material relative to the reactive material in the infiltrant material be controlled to minimize and/or eliminate the possibility of such material acting in a catalytic function during the infiltration process. Specifically, it is desired that the amount of the nonreactive material in the infiltrant material be sufficient to reduce the melting temperature of the infiltrant material, to a temperature below that of the catalyst material, and to provide a degree of control over the reactive material reaction rate, but yet minimize the tendency for such nonreactive material to act as a catalyst to the diamond during infiltration and/or during subsequent use of the diamond body in a wear or cutting operation.

It is theorized that the reactive material used in the infiltrant material reacts with the diamond crystals to form a barrier on the surface of diamond crystals, which barrier operates to prevent the nonreactive material in the infiltrant material from contacting the diamond crystals. Thus, the plurality of second regions are believed to contain a reaction product along an outer boundary adjacent the surrounding diamond crystals, and an inner portion that is surrounded by reaction product that contains the nonreactive material, wherein the reaction product operates as a barrier to prevent the diamond crystals from contacting the nonreactive material and thereby preventing the nonreactive material from causing any undesired catalytic effect with the diamond crystals. Additionally, it is desired that the amount of the nonreactive material that is used is such that its presence within the plurality if second regions will not create a thermal expansion differential within the construction during use that will adversely impact performance or service life of the construction.

Preferably, the reactive material included in the infiltrant material is one that reacts with the diamond to form a reaction product therewith. In a preferred embodiment, the reactive material is one that is capable, alone or when combined with another material, of melting and reacting with diamond in the solid state during processing of the diamond-bonded materials at a temperature that is below the melting temperature of the catalyst material in the PCD region of the diamond-bonded body. Additionally, such reactive materials would include those that, upon reacting with the diamond, form a compound having a coefficient of thermal expansion that is relatively closer to that of diamond than that of the catalyst material used to initially sinter the diamond-bonded body. Additionally, it is also desired that the compound formed by reaction of the reactive material with diamond have significantly high-strength characteristics.

Desired reactive materials include those capable of forming carbides when combined with diamond at suitable HPHT conditions. Suitable reactive materials useful for forming diamond-bonded constructions of this invention include Ti, Si, W, Cr, Zr, Hf, Va, Nb, Ta, and Mo. Other suitable materials useful for forming the infiltrant material include those formed from metals, refractory metals, ceramic materials, and combinations thereof. These materials may typically include one or more of the following elements: Si, Cu, Sn, Zn, Ag, Au, Ti, Cd, Al, Mg, Ga, Ge, and other metals that do not form carbides and that are capable of improving the toughness of the resulting diamond body, and/or reducing the melting temperature of the infiltrant material to facilitate the infiltration process.

In a preferred embodiment, the infiltrant material comprises a mixture of a desired reactive material in the form of Ti, and a desired nonreactive material in the form of Ni. Ni is used to reduce the melting temperature of the infiltrant material to one that is below that of the catalyst material remaining in the PCD region of the diamond body. Ti is used because it produces a desired reaction product, TiC, when combined with diamond under conditions of HPHT. In an example embodiment, the infiltrant material may comprise in the range of from about 5 to 25 percent by volume nonreactive material, e.g., Ni, and preferably about 15 percent by volume No, and a remainder amount Ti. It is to be understood that the amount of nonreactant and reactive material used to form the infiltrant material can and will vary depending on the types of materials used.

In an example embodiment, the treated diamond-bonded body is loaded into a container for placement within the HPHT device for HPHT processing. Before being placed into the container, a desired infiltrant material is positioned adjacent a surface of the treated area of the diamond-bonded body to facilitate infiltration into the treated region during the HPHT process. During the HPHT process, the infiltrant material melts and infiltrates into the adjacent surface of the treated region of the diamond-bonded body and partially or completely fills the plurality of voids existing in the interstitial regions. In the case where the infiltrant material includes Ti as the reactive material, the Ti reacts with the diamond crystals within the polycrystalline matrix phase to form a TiC reaction product within the interstitial regions, thereby forming the plurality of second phases within the material microstructure.

In such example embodiment, where the infiltrant material comprises Ti as the selected reactive material, it is desired that the HPHT process be conducted at a temperature sufficient to melt the infiltrant material, at a pressure high enough to keep the diamond thermodynamically stable, (this pressure may be lower than that used during the process of initially forming the diamond-bonded body due to the fact that this operation is carried out at lower temperatures than the forming process), and for a sufficient period of time, e.g., from about 1 to 20 minutes. This time period must be sufficient to melt all of the infiltrant material, to allow the Ti reactive material to infiltrate the treated region of the diamond-bonded body, and to allow the infiltrated Ti to react with the diamond crystals in this region to form the desired TiC occupying the plurality of second phases. In an example embodiment, it is desired that a sufficient amount of the infiltrant material be melted and infiltrated for the purpose of both forming the desired reaction product within the diamond-bonded body and also forming an optional material layer on a surface of the diamond-bonded body, the material layer having a desired layer thickness.

While particular HPHT pressures, temperatures and times have been provided, it is to be understood that one or more of these process variables may change depending on such factors as the type and amount of materials used to form the infiltrant material, and/or the type of diamond-bonded body. A key point, however for this particular embodiment, is that the HPHT process for infiltrating the infiltrant material be below the melting temperature of the catalyst material remaining in the PCD region of the diamond-bonded body, to permit the infiltrant material to infiltrate and react with the diamond-bonded crystals without the catalyst material in the PCD region infiltrating into the treated region.

The infiltrant material, when introduced by HPHT process, can be provided in the form of a solid object such as a metal alloy foil, e.g., a titanium foil, or can be provided in the form of a powder that is positioned adjacent a surface of the treated region of the diamond-bonded body, thereby infiltrating during the HPHT process into the treated region to fill the voids and pores disposed therein formed by removal of the catalyst material.

Other methods of introducing the infiltrant material into the diamond-bonded body can be by coating or partially infiltrating the body surface and voids in the treated region prior to placing the body in the HPHT device by processes such as Chemical Vapor Deposition (CVD) or Physical Vapor Deposition (PVD). Other methods such as wet chemical plating, or electro-deposition, or filling the voids with the infiltrant material provided in a liquid phase, e.g., via an organic or inorganic liquid carrier may also be employed. Such methods of introducing the infiltrant material to the diamond-bonded body, i.e., to the treated region, can be used as an alternative or in addition to introducing the infiltrant material during the HPHT process.

When the infiltrant material is provided in the form of a coating prior to placement of the diamond-bonded body in the HPHT device, the infiltrant material can achieve a desired degree of penetration into the treated material to fill the empty voids within the treated region. The exact depth of penetration can and will vary on a number of factors such as the type of coating technique used, the types of materials used to form the infiltrant material, and the type of material used to form the diamond-bonded body. An advantage of using such a coating technique to introduce the infiltrant material into the diamond-bonded body is that it would result in a smaller volume change during HPHT processing, which would also provide a more predictable and controlled HPHT process and resulting product.

A further advantage of introducing some or all of the infiltrant material in this manner is that it would reduce the amount of entrained gas in the product formed during the HPHT process, which would also help achieve a compact having a higher material density and possibly having better heat transfer properties, i.e., resulting from reducing the total volume of unfilled void space within the construction, thereby reducing the amount of heat transfer by convection and increasing the amount of heat transfer by conduction, which can operate to increase the overall heat transfer capability of the resulting diamond-bonded body. Reducing the amount of entrained gas within the compact is also desired during the HPHT process as such gas operates to potentially reduce the extent of desired chemical reactions between the reactive material and the polycrystalline phase material.

If the infiltrant material is applied to the diamond-bonded body prior to HPHT processing, the resulting diamond-bonded body is then subjected to the HPHT process as described above to achieve any further desired extent of infiltration in addition to producing the desired reaction product between the reactive material and the polycrystalline matrix phase material.

Alternatively, the infiltrant material can be provided in the form of a slurry or liquid or a gel, e.g., in the form of a sol gel, polymer material or the like, comprising the desired reactive material. In an example embodiment, the reactive material is Ti, and can be provided in the form of titanium nitride or the like. In an example embodiment, when the infiltrant material is provided in the form of a liquid or sol get, it can be introduced into the diamond body at a relatively low temperature without the need to elevated temperature. In an example embodiment, the infiltrant material can be introduced into the diamond body at a temperature at about 700° C. for a sufficient amount of time to provide a desired degree of infiltration and reaction product without having to use elevated pressure. Accordingly, using an infiltrant material in such a form enables infiltration to take place by subjecting the diamond body to the liquid infiltrant material, e.g., by immersion or the like, under elevated temperature conditions, e.g., by using an autoclave or the like. The diamond body can then be placed in a vacuum furnace and the desired reaction product, e.g., TiC, can be formed at a temperature of about 700° C.

In an example embodiment, the infiltrant material infiltrates into the entire diamond-bonded body treated region, thereby providing a thermally stable diamond-bonded region extending a desired depth from the working surface. In certain situations, however, it may be difficult for the infiltrant material to infiltrate and fill the entire treated region, in which case a portion of the treated region may not be filled with the infiltrant material and such portion may still include some population of unfilled or partially filled voids or pores. Alternatively, it may be intentionally desired that some population of the voids in the treated region remain unfilled. This may be desired, for example, for the purpose of providing a thermally and/or electrically insulating layer within the diamond body. Accordingly, it is to be understood that plurality of voids or empty pores existing in the diamond body treated region may be completely or only partially filled with the infiltrant material and the reaction product that is formed therefrom.

In a preferred embodiment, all or a substantial portion of the voids or pores in the treated region are filled with the infiltrant material, thus all or a substantial population of the voids or empty pores existing in this region will contain the reactive material. It is understood that in those cases where the infiltrant material includes a nonreactive material, that the pores or empty voids that are filled or partially filled with such infiltrant material will include not only the reaction product, but will include the nonreactive material and may include some unreacted reactive material. In a preferred embodiment, substantially all of the reactive material in the infiltrant material is reacted. When the infiltrant material includes Ti as a reactive material, the infiltrated titanium forms a reaction phase with the diamond crystals in the diamond-bonded phase according to the reaction:

$$Ti+C=TiC$$

This reaction between titanium and carbon present in the diamond crystals is desired because the reaction product, TiC, has a coefficient of thermal expansion that is closer to diamond than that of the catalyst material that was initially used to sinter the diamond body and that remains within the PCD region of the diamond-bonded body. Additionally, the presence of TiC provides improved properties of strength and fracture toughness to the diamond-bonded body when compared to the preexisting state of the treated region of the diamond-bonded body comprising empty voids or pores. Additionally, as noted above, it is theorized that the TiC forms on the surfaces of the diamond crystals, thereby providing a barrier or layer that can operate to protect the diamond crystals from any nonreactive material used in the infiltrant material chemically, and any relating catalyst effect that such material may have on the diamond crystals during the HPHT process or during subsequent use of the diamond body in a particular wear and/or cutting operation.

Further, the presence of TiC adjacent the interface between the diamond-bonded body region comprising the same and the PCD region operates to minimize or dilute the otherwise large difference in the coefficient of thermal expansion that would otherwise exist between these regions, thereby operating to minimize the development of thermal stress in at the interface between the treated and untreated diamond-bonded body regions, thereby improving the overall thermal stability of the entire diamond-bonded body.

It is to be understood that the amount of the infiltrant material used for forming diamond bonded constructions of this invention can and will vary depending on such factors as the size and volume content of the diamond crystals in the treated region, the volume of the treated diamond-bonded region to be infiltrated, the type of materials used to form the infiltrant material, the desired layer thickness of reactive material internally within the region on the diamond crystals, the formation and thickness of any material layer on a surface of the diamond-bonded body, in addition to the particular end-use application for the resulting diamond-bonded construction. It is preferred that the amount of the infiltrant material used be sufficient to infiltrate a desired volume of the treated region and form the desired reaction product having a desired thickness within the interstitial regions of the treated region. As note above, optionally, the amount of infiltrant material used can also take into account the formation of a material layer having a desired thickness formed on at least a portion of the diamond body surface.

In an example embodiment, the source of Ti if used as the reactive material for infiltration is provided in the form of a titanium metal or metal alloy disk. As noted above, the amount of Ti that is used can influence the depth of infiltration, the extent of diamond bonding via the resulting reaction product, and the thickness any material layer formed on at least a portion of the diamond body surface. In an example embodiment, where the diamond body has a diameter of approximately 16 mm and the leach depth is approximately 0.08 mm, the volume of the infiltrant material needed to fill the interstitial regions will depend on the extent of the porosity within this region. As an example, when the porosity in such example is approximately 5 percent, approximately 0.8 cubic mm of the infiltrant material can be used, and when the porosity in such example is approximately 10 percent, the amount of infiltrant material will be greater by a factor of 2 or 1.6 cubic mm.

Although formation of a the diamond-bonded body region comprising the reaction product has been described by using a single infiltrant material, it is to be understood that such diamond-bonded region can formed by using two or more infiltrant materials. For example, a first infiltrant material comprising a first reactive material can be used to occupy some population of the voids disposed within the treated diamond-bonded body, and a second infiltrant material comprising second reactive material can be used to occupy some other population of the voids. In such example embodiment, the first infiltrant material can be used to fill the voids in one particular region, e.g., a region nearest the diamond-body surface, while the infiltrant reactive material can be used to fill the voids in another particular region, e.g., a region adjacent the PCD region. In addition to using two or more infiltrant materials to form different volumes within the thermally stable region, the infiltrant material can be combined so that they occupy the same volume within the thermally stable region.

As noted above, in an example embodiment, the infiltrant materials that are selected react with the polycrystalline matrix phase to form a reaction product therewith, which reaction product can be different. The reaction product resulting from the use of the different reactive materials can be positioned in the same or in different portions of the thermally stable region diamond-bonded body.

It is to be understood that the particular infiltrant materials that are used in each such embodiments can be tailored to provide the desired thermal and/or mechanical properties for each such portion of the thermally stable region, thus providing a further ability to customize the performance properties of the thermally stable region in the diamond-bonded body to meet the specific demands of a particular end-use application.

In another example embodiment, diamond-bonded constructions are prepared by removing the catalyst material used to form the diamond-bonded body completely therefrom rather than by removing the catalyst material from only a targeted region of the diamond-bonded body. In such embodiment, a diamond-bonded body comprising PCD is formed in the manner described above by HPHT process, and the entire so-formed PCD body is treated to remove the catalyst material therefrom so that the resulting entire diamond-bonded body is substantially free of the catalyst material.

In such embodiment, the resulting catalyst free diamond-bonded body is then subjected to a treatment whereby the infiltrant material is introduced into a region of the body to occupy the empty pores or voids in such region, and to form the desired reaction product within the pores. Additionally, the catalyst free diamond-bonded body is treated so that the empty pores or voids in another region of the body are filled with another infiltrant, wherein such other infiltrant is different from that used to produce the reaction product, and wherein the infiltrant used to produce the reaction product is selected from the same types of materials described above, e.g., in a preferred embodiment can include Ti to form a TiC reaction product.

The other infiltrant that is used to fill the pores in the other region of the diamond body can be formed from materials that assist in providing a desired degree of fracture toughness and mechanical strength to the diamond body. Further, it is desired that such other infiltrant be one that is capable of providing a bonded attachment with a desired substrate to form a diamond-bonded compact. Suitable materials that can be used as the other infiltrant includes those in Group VIII of the Periodic table and alloys thereof. Other suitable materials that can be used as the other infiltrant can include nonrefractory metals, ceramic materials, cermet materials, and combinations thereof. The other infiltrant may or may not include a constituent that can react with the diamond within the diamond-bonded body to form a reaction product, i.e., the other infiltrant may include a carbide former or the like. In an example embodiment, the other infiltrant is Cobalt. A feature of the material that is used to form the other infiltrant is that it have a melting temperature higher than that of the infiltrant used to introduce the reactive material to form the reaction product.

Such other example embodiment diamond-bonded body is formed by treating the entire diamond body to remove the catalyst material therefrom by the same method as described above, e.g., by acid leaching process of the like. Where the PCD body includes a substrate, the substrate can be removed prior to treatment to facilitate the catalyst removal process, or can be removed and/or allowed to fall away from the diamond-bonded body after the treatment, by virtue of the catalyst material no longer being present to provided a bonded attachment therebetween.

The resulting diamond-bonded body is substantially free of the catalyst material and is loaded into a container for subsequent HPHT processing. A source of the infiltrant is positioned adjacent a desired surface of the diamond-bonded body for receiving the infiltrant therein, and a source of the other infiltrant is positioned adjacent another desired surface of the diamond-bonded body for receiving the other infiltrant therein. In an example embodiment, the source of the infiltrant used for introducing the reactive material can be in the same form as that described above, and in an example embodiment, is provided in the form of a foil, and in a preferred embodiment the foil comprises a Ti/Ni alloy. In an example embodiment, the source of the other infiltrant can be provided in the form of a substrate, that can be in the same form and/or formed from the same materials described above for forming the PCD diamond-bonded body. In an example embodiment, a WC—Co substrate is used as the source of the other infiltrant, wherein the other infiltrant is Cobalt.

In an example embodiment, the infiltrant can be positioned to cover working surfaces of the diamond-bonded body, which can include the same diamond-bonded body surfaces described above, e.g., including the diamond table, wall surface, and/or beveled edge. In an example embodiment, the other infiltrant is positioned along a surface of the diamond-bonded body where a desired attachment to a substrate is desired, which can vary depending on the particular end-use application.

The container is loaded into an HPHT device and the device is operated to cause a sequential melting and infiltration of the infiltrant material comprising reactive material, and then the melting and infiltration of the other infiltrant material. The extent of infiltration, i.e., the depth of infiltration into the diamond-bonded body, by the infiltrant material comprising the reactive material can be controlled by the volume of the infiltrant material that is provided and/or by the extent of time that the HPHT process is held at the infiltrant melting temperature and/or the reaction material reaction temperature. In an example embodiment, the volume of infiltrant material that is provided and/or the duration that the HPHT process is help at the infiltrant melting temperature is such as sufficient to facilitate formation of a region within the diamond body comprising the reaction product within the pores to depth as described above.

The HPHT device can be operated to provide a stepped temperature change from a first temperature (to melt the infiltrant comprising the reaction material) to a second temperature (to melt the other infiltrant) after a sufficient period of time has passed. Alternatively, the HPHT device can be operated to provide a gradient temperature change moving gradually from the first temperature to a second temperature over a sufficient period of time. In both operations, the sufficient period of time is that which permits formation of the region within the diamond-body having the reaction product within the pores to the desired depth.

Once the desired depth of the diamond-bonded body region comprising the reaction product is formed the temperature of the HPHT device increases to the melting temperature of the other infiltrant to cause it to melt and infiltrate into a region of the diamond-bonded body not already filled with the reaction product. In the example embodiment where the other infiltrant is provided as a constituent of a substrate, such infiltration of the other infiltrant operates to form a bonded attachment between the diamond-bonded body and the substrate. The HPHT device is operated at this higher temperature for a period of time sufficient to fill the other region of the diamond-bonded body and/or to ensure that a desired attachment bond is formed between the diamond-bonded body and the substrate.

In such example embodiment, it is desired that resulting diamond-bonded body comprise a first region (comprising a reaction product disposed within the interstitial regions between the bonded-together diamond crystals) and a second region (comprising the other infiltrant material disposed within the interstitial regions). There may be some overlap or an interface between the first and second regions, or alternatively there may be a region within the diamond-bonded body between the two regions that comprises empty interstitial regions. In an example embodiment, the first region extends a depth within the diamond-bonded body as described above, and the second region extends between the first region and the substrate.

Figure 6:
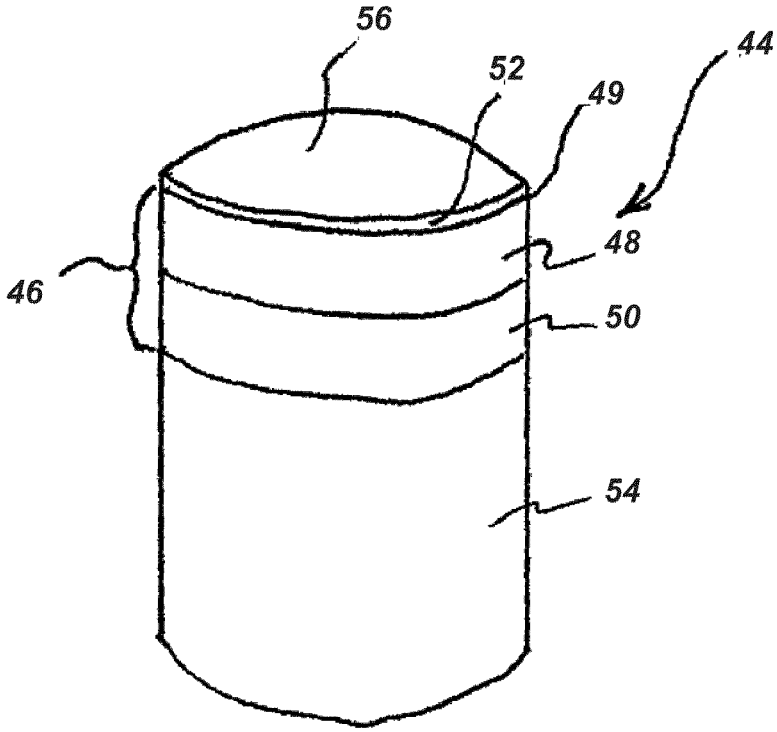
FIG. 6 is a perspective view of a diamond-bonded construction of this invention after a process step where an infiltrant material has been introduced into the construction after partial removal of the catalyst material.

FIG. 6 illustrates a perspective view of a thermally stable diamond-bonded construction 44 constructed according to principles described above. Generally speaking, such construction 44 comprises a diamond-bonded body 46 having the thermally stable diamond-bonded region 48 extending a depth from a diamond-bonded body surface 49, and a further region 50 that either comprises conventional PCD (i.e., that includes the catalyst material used to form the diamond-bonded body) or that comprises a region including another infiltrant disposed within the interstitial regions that is not the catalyst material that was used to initially form the diamond-bonded body. The construction 44 also includes a material layer 52 that is disposed along at least a portion of a surface of the diamond-bonded body. It is to be understood, the diamond-bonded constructions of this invention may be formed with or without the material layer 52, depending on the particular end-use application. The material layer 52 is formed from the infiltrant material and, in an example embodiment, comprises the reaction product formed by reaction of the reactive material with the diamond in the diamond-bonded body. The construction 44 illustrated in FIG. 6 is provided in the form of a compact comprising a substrate 54 attached to the diamond-bonded body 46. In an example embodiment, the substrate 43 is attached to the diamond-bonded body 46 via the region 50.

As described above, the optional material layer 52 can be formed during the HPHT process of infiltrating the infiltrant material and reacting reaction material within the same within the diamond-bonded body, during which process the material layer is formed in situ during infiltration and reaction product formation. Alternatively, the material layer 52 can be formed separately from the HPHT process used to form the reaction product within the diamond-bonded body, e.g., by depositing a desired thickness of the infiltrant material onto the designated surface of the diamond-bonded body, and then subjecting the surface to temperature and/or pressure conditions sufficient to form the reaction product on the diamond body surface. Further still, the material layer can be formed independent of the HPHT process by depositing a desired thickness of a reaction product, e.g., TiC, onto a surface of the diamond-bonded body by CVD, PVD or other conventional process.

The thickness of the material layer can and will vary depending on the particular diamond-bonded body size, shape, and end-use application, as well as the material selected for forming the material layer. In an example embodiment, the material layer thickness can be less than about 100 micrometers, preferably in the range of from about 0.5 micrometers to 50 micrometers, and more preferably in the range of from about 5 to 30 micrometers.

The material layer can occupy a partial portion of a surface or cover an entire surface region of the body. In the example embodiment illustrated in FIG. 6, the material layer 52 covers an entire portion of a top surface 49 of the diamond-bonded body 46. Alternatively, the material layer can cover none or only a potion of the diamond-bonded body top surface and/or can cover none, a portion, or all of a sidewall surface of the diamond-bonded body. For example, the material layer may cover only the diamond-bonded body top surface and not its side surface, the material layer may cover both the diamond-bonded body top and side surfaces, or the material layer may only cover the diamond-bonded body side surface. The exact placement and extent of placement of the material layer on the diamond-bonded body will vary depending on the particular construction configuration and end use. In an example embodiment, it is desired that the material layer be positioned along a portion of the diamond-bonded body to form a working and/or cutting surface for the construction.

While the diamond-bonded construction 44 is illustrated having a generally cylindrical wall surface with a working surface 56 positioned along an axial end of the construction, it is to be understood that diamond-bonded constructions of this invention can be configured having a variety of different shapes and sizes, with differently oriented working surfaces, depending on the particular wear and/or cutting application, e.g., based on the different PCD compact constructions illustrated in FIGS. 2B to 2E.

Figure 7A:
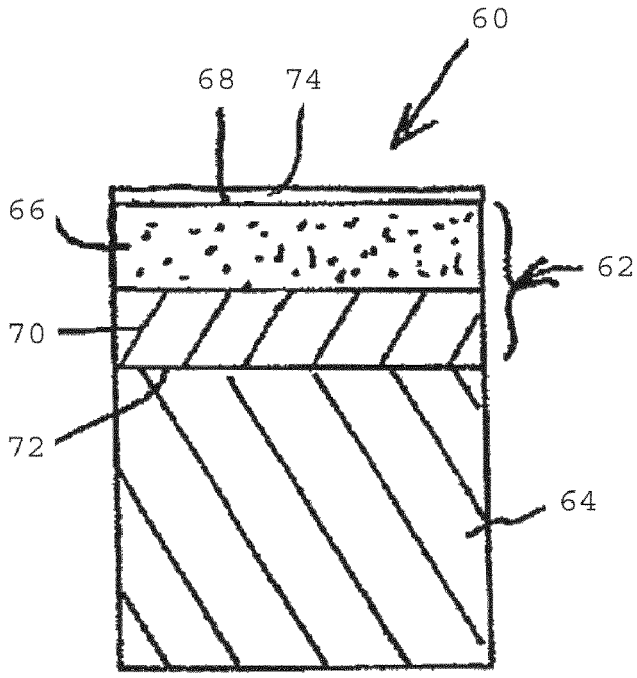
FIGS. 7A and 7B are cross-sectional side views of different diamond-bonded constructions of this invention.
Figure 7B:
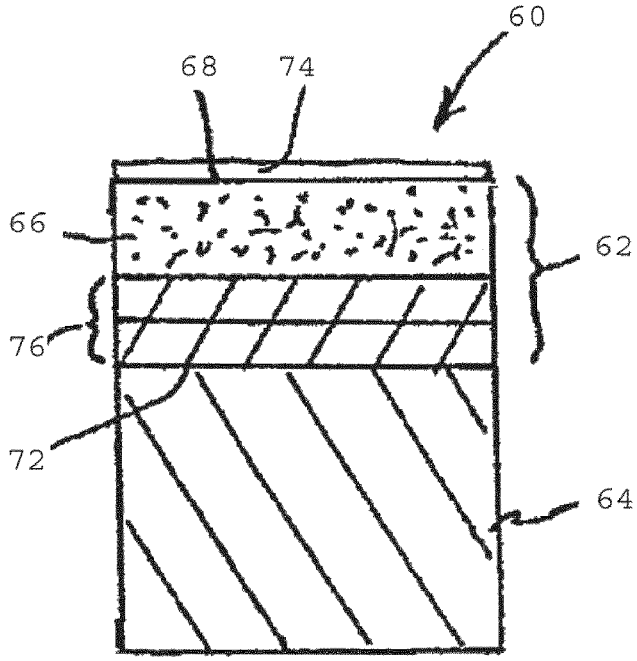

FIGS. 7A and 7B each illustrate a cross-sectional side views of different diamond-bonded constructions 60 of this invention, each one comprising a diamond-bonded body 62 that is attached to a substrate 64. The diamond-bonded body 62 comprises a thermally stable diamond-bonded region 66 that extends a depth from a surface 68 of the diamond-bonded body. The thermally stable diamond-bonded region 66 has a material microstructure comprising a polycrystalline diamond matrix first phase of bonded together diamond crystals, and a second phase of the reaction product disposed interstitially within the matrix phase, as best illustrated in FIG. 1. Because the second phase is disposed within the interstitial regions of the material microstructure, that previously existed as voids, the second phase may also be referred to herein as a plurality of second phases as such are dispersed throughout the matrix phase. As noted above, this region 66 has an improved degree of thermal stability when compared to conventional PCD, due both to the absence of the catalyst material used to form the diamond-bonded body and to the presence of the reaction product, as this reaction product has a coefficient of thermal expansion that more closely matches diamond as contrasted to a catalyst material such as Cobalt.

The diamond-bonded body 62 includes another region 70, which can be a conventional PCD region or a diamond-bonded region that includes another infiltrant and that is substantially free of the catalyst material used to initially form the diamond-bonded body. This other region 70 extends a depth from the thermally stable diamond-bonded region 66 through the body 62 to an interface 72 between the diamond-bonded body and the substrate 64. As noted above, in an example embodiment, the other region 70 facilitates a desired attachment bond with the substrate, thereby ensuring use and attachment of the resulting diamond-bonded construction to a desired end-use application device by conventional means like welding, brazing or the like.

An optional material layer 74 is disposed along a surface 68 of the diamond-bonded body 62. In this example embodiment, the material layer 74 is disposed along a top surface of the thermally-stable region 66 of the diamond bonded body, and forms at least a portion of a working surface of the construction. In an example embodiment, the presence of a material layer formed from the reaction product results from the process of infiltrating and forming the reaction product within the diamond body during HPHT conditions. The material layer can be removed if desired, or can be left alone and/or machined to a desired thickness and/or configuration.

FIG. 7B illustrates another embodiment thermally stable diamond-bonded construction 60 prepared according to this invention. Unlike the construction embodiment illustrated in FIG. 7A, in this particular embodiment the diamond-bonded body 62 is formed from more than one layer of diamond material. The diamond-bonded body of this construction embodiment is formed by combining two diamond-containing bodies 76. The diamond-containing bodies can be provided as green-state unsintered parts that are joined/bonded together by HPHT process. During such HPHT processing, the two or more green-state diamond-containing bodies 76 are bonded together, e.g., by solvent metal infiltration, adjacent diamond-to-diamond bonding, and the like. Alternatively, the diamond bodies can be provided in the form of different diamond powder volumes that are positioned adjacent one another prior to HPHT processing. If desired, the diamond density, and/or diamond grain size, and/or use of/type of catalyst material in the two diamond-containing bodies used to form this construction embodiment can vary depending on the particular desired performance characteristics.

In the example embodiment illustrated in FIG. 7B, both diamond bodies 76 form either PCD regions of the diamond-bonded body 62 or regions of the diamond body that contains an infiltrant and that is substantially free of the catalyst material used to initially form the diamond body, and have different diamond volume contents, e.g., the diamond volume content nearest the thermally stable diamond-bonded region 66 is greater than that nearest the substrate 64. Alternatively or additionally, each layer may be formed from differently sized diamond grains. Further still, the diamond-containing bodies can be arranged to form part of all of the thermally stable diamond-bonded region.

Diamond-bonded constructions of this invention will be better understood with reference to the following examples:

Example 1

Diamond-Bonded Construction by Partial Leaching

Synthetic diamond powder having an average grain size of approximately 2 to 50 micrometers is mixed together for a period of approximately 2-6 hours by ball milling. The resulting mixture is cleaned by heating to a temperature in excess of 850° C. under vacuum. The mixture is loaded into a refractory metal container. A WC—Co substrate is positioned adjacent a surface of the diamond powder volume. The container is surrounded by pressed salt (NaCl) and this arrangement is placed within a graphite heating element. This graphite heating element containing the pressed salt and the diamond powder and substrate encapsulated in the refractory container is loaded into a vessel made of a high pressure/high temperature self-sealing powdered ceramic material formed by cold pressing into a suitable shape.

The self-sealing powdered ceramic vessel is placed in a hydraulic press having one or more rams that press anvils into a central cavity. The press is operated to impose an intermediate stage processing pressure and temperature condition of approximately 5,500 MPa and approximately 1,450° C. on the vessel for a period of approximately 5 minutes. During HPHT processing, Cobalt from the WC—Co substrate infiltrates into the adjacent diamond powder mixture, and intercrystalline bonding between the diamond crystals takes place forming PCD.

The vessel is opened and the resulting PCD compact is removed therefrom. A region of the diamond-bonded PCD body is treated by acid leaching to remove the catalyst material, i.e., Cobalt, therefrom to a depth of approximately 0.055 mm. After the leaching treatment is completed, the treated diamond-bonded body with substrate bonded thereto is again loaded into the HPHT device and a infiltrant material comprising a Ti, Cu, Ni disk is positioned adjacent the treated region. The HPHT device is operated to impose approximately 5,500 MPa and approximately 1,100° C. for a period of approximately 2 minutes. During which time the infiltrant material melts and infiltrates into the treated region to fill the empty voids and pores created by removing the catalyst material, and the Ti reacts with the diamond crystals to form a reaction product, i.e., TiC. Further, during this HPHT process the infiltrant material reacts with the diamond along a surface of the diamond-bonded body to form a material layer of TiC along at least a portion of the surface. The material layer has a thickness of approximately 2 to 40 micrometers. The material layer can be removed if desired depending on the end-use application.

The so-formed diamond-bonded construction has a diamond-bonded body with a thermally diamond-bonded region of approximately 0.055 mm thick having a microstructure characterized by a polycrystalline diamond matrix first phase and a TiC second phase occupying a major population of the empty voids. The total diamond body thickness was approximately 2.5 mm, and the PCD region had a thickness of approximately 1.95 mm. The diamond-bonded body PCD region was attached to the WC—Co substrate having a thickness of approximately 13 mm.

Example 2

Diamond-Bonded Construction by Complete Leaching

A PCD body was prepared in the same manner described above in Example 1. The entire diamond-bonded PCD body is treated by acid leaching to remove the catalyst material, i.e., Cobalt, therefrom. Before the body is treated, the substrate is removed to facilitate the process of removing the catalyst material therefrom. After the leaching treatment is completed, the treated diamond-bonded body is loaded into the HPHT device and a infiltrant material comprising a Ti, Cu, Ni disk is positioned adjacent a first region of the body and a WC—Co substrate is positioned adjacent a second region of the body.

The HPHT device is operated to impose approximately 5,500 MPa and approximately 1,100° C. for a period of approximately 2 minutes. During which time the infiltrant material melts and infiltrates into the first region of the diamond body to fill the empty voids and pores existing therein, and the Ti reacts with the diamond crystals to form a reaction product, i.e., TiC. Further, during this HPHT process the infiltrant material reacts with the diamond along a surface of the diamond-bonded body to form a material layer of TiC along at least a portion of the surface. The material layer has a thickness of approximately 2 to 40 micrometers, and can be removed if desired.

While at the same pressure, the HPHT device is operated to impose an elevated temperature of approximately 1,450° C. for a period of approximately 5 minutes. During this time the other infiltrant material, Cobalt, in the substrate melts and infiltrates into the second region of the diamond-bonded body to fill the empty voids and pores existing therein, and provides a desired attachment bond between the substrate and the diamond body.

The so-formed diamond-bonded construction has a diamond-bonded body with a thermally diamond-bonded first region of approximately 0.055 mm thick having a microstructure characterized by a polycrystalline diamond matrix first phase and a TiC second phase occupying a major population of the empty voids. The total diamond body thickness was approximately 2.5 mm, and the second region had a thickness of approximately 1.95 mm. The diamond-bonded body second region was substantially free of the catalyst material used to initially form the PCD body and was attached to the WC—Co substrate, which substrate had a thickness of approximately 13 mm.

Such diamond-bonded constructions displayed properties of improved fracture toughness, strength and impact resistance when compared to conventional thermally stable PCD that has been rendered such by removing the catalyst material used to sinter the diamond body either fully or partially therefrom, and that has a material microstructure comprising a resulting plurality of empty pores or voids. In an example embodiment where such diamond-bonded construction is configured in the form of a cutting element having a diameter of approximately 13 mm, such diamond-bonded construction displayed improved wear resistance, as measured by mill score length, of approximately 300 percent when compared to an identically sized cutting element formed from conventional PCD construction, and approximately 50 percent when compared to a conventional TSP construction containing the plurality of empty voids resulting from the removal of the catalyst material.

A feature of diamond-bonded constructions of this invention is that they comprise a diamond-bonded body having a first region that includes a reaction product and that is substantially free of the catalyst material used to form the body, and comprise a further second region that either comprises PCD or that is also substantially free of the catalyst material. The population of interstitial regions within the diamond-bonded body is substantially filled, thereby providing a resulting material microstructure having an improved degree of mechanical strength, toughness, and thermal stability. Further, the diamond-bonded construction may also include a material layer disposed on at least a portion of the diamond-bonded body surface that forms at least a portion of the construction working surface, and that improves the impact strength and fracture toughness of the compact. Still further, diamond-bonded constructions of this invention include a substrate bonded to the diamond-bonded body, thereby enabling constructions of this invention to be attached by conventional methods such as brazing, welding or the like to a variety of different tooling, cutting and/or wear devices to greatly expand the types of potential end-use applications.

Diamond-bonded constructions of this invention can be used in a number of different applications, such as tools for mining, cutting, machining and construction applications, where the combined properties of thermal stability, strength/toughness, impact strength, and wear and abrasion resistance are highly desired. Diamond-bonded constructions of this invention are particularly well suited for use as working, wear and/or cutting components in machine tools for lathing and or milling, and drill and mining bits, such as roller cone rock bits, percussion or hammer bits, diamond bits, and shear cutters used for drilling subterranean formations.

Figure 8:
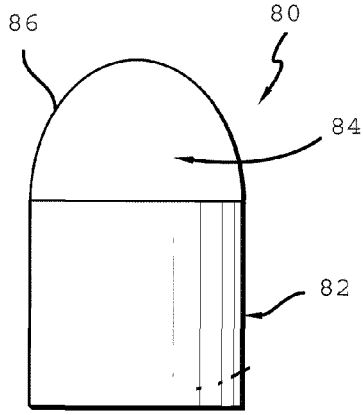
FIG. 8 is a perspective side view of an insert, for use in a roller cone or a hammer drill bit, comprising the diamond-bonded constructions of this invention.

FIG. 8 illustrates an embodiment of a diamond-bonded construction of this invention provided in the form of an insert 80 used in a wear or cutting application in a roller cone drill bit or percussion or hammer drill bit. For example, such inserts 80 can be formed from blanks comprising a substrate portion 82 formed from one or more of the substrate materials disclosed above, and a diamond-bonded body 84 having a working surface 86 formed from the thermally stable region of the diamond-bonded body. The blanks are pressed or machined to the desired shape of a roller cone rock bit insert.

Figure 9:
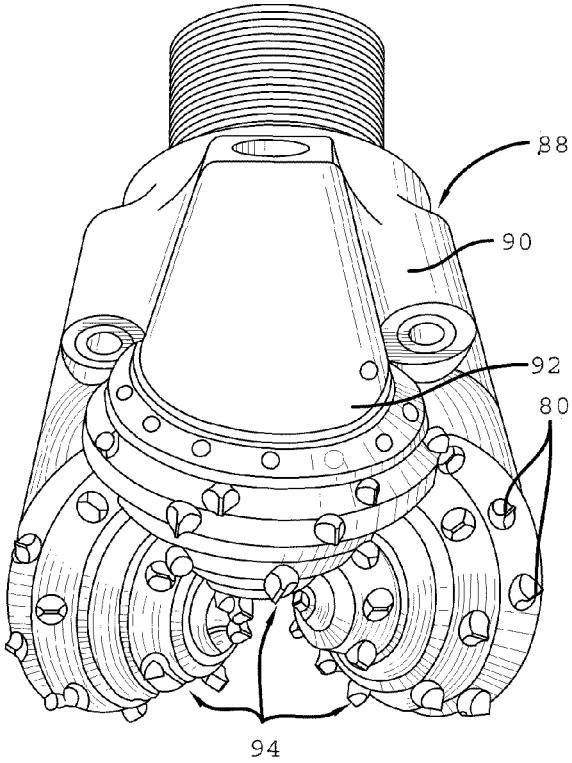
FIG. 9 is a perspective side view of a roller cone drill bit comprising a number of the inserts of FIG. 8.

FIG. 9 illustrates a rotary or roller cone drill bit in the form of a rock bit 88 comprising a number of the wear or cutting inserts 80 disclosed above and illustrated in FIG. 8. The rock bit 88 comprises a body 90 having three legs 92, and a roller cutter cone 94 mounted on a lower end of each leg. The inserts 80 can be fabricated according to the method described above. The inserts 80 are provided in the surfaces of each cutter cone 94 for bearing on a rock formation being drilled.

Figure 10:
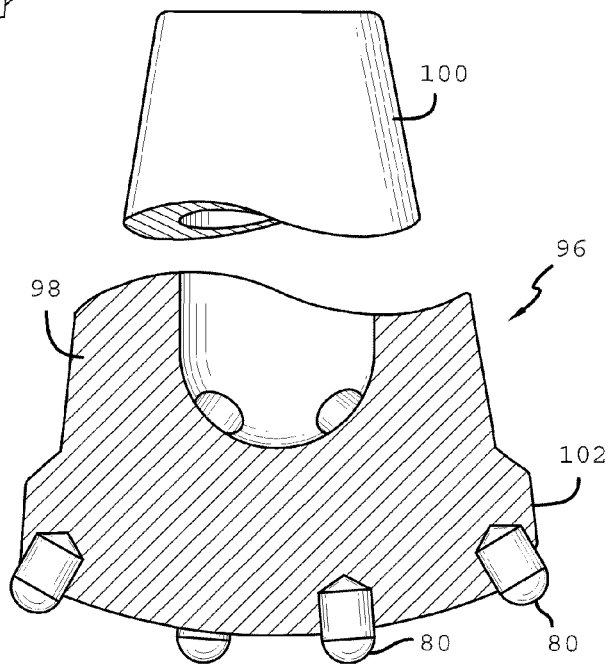
FIG. 10 is a perspective side view of a percussion or hammer bit comprising a number of inserts of FIG. 8.

FIG. 10 illustrates the inserts 80 described above as used with a percussion or hammer bit 96. The hammer bit comprises a hollow steel body 98 having a threaded pin 100 on an end of the body for assembling the bit onto a drill string (not shown) for drilling oil wells and the like. A plurality of the inserts 80 is provided in the surface of a head 102 of the body 98 for bearing on the subterranean formation being drilled.

Figure 11:
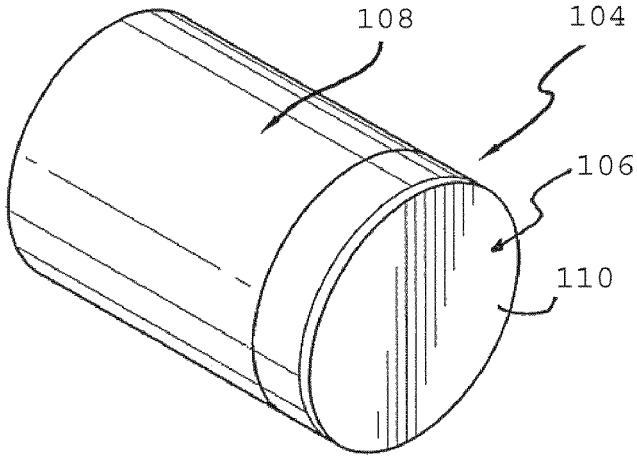
FIG. 11 is a schematic perspective side view of a diamond shear cutter comprising the diamond-bonded constructions of this invention.

FIG. 11 illustrates a diamond-bonded construction of this invention as embodied in the form of a shear cutter 104 used, for example, with a drag bit for drilling subterranean formations. The shear cutter 104 comprises a diamond-bonded body 106 that is sintered or otherwise attached to a cutter substrate 108. The diamond-bonded body 106 includes a working or cutting surface 110 that includes the material layer that is disposed on a surface of the diamond-bonded body.

Figure 12:
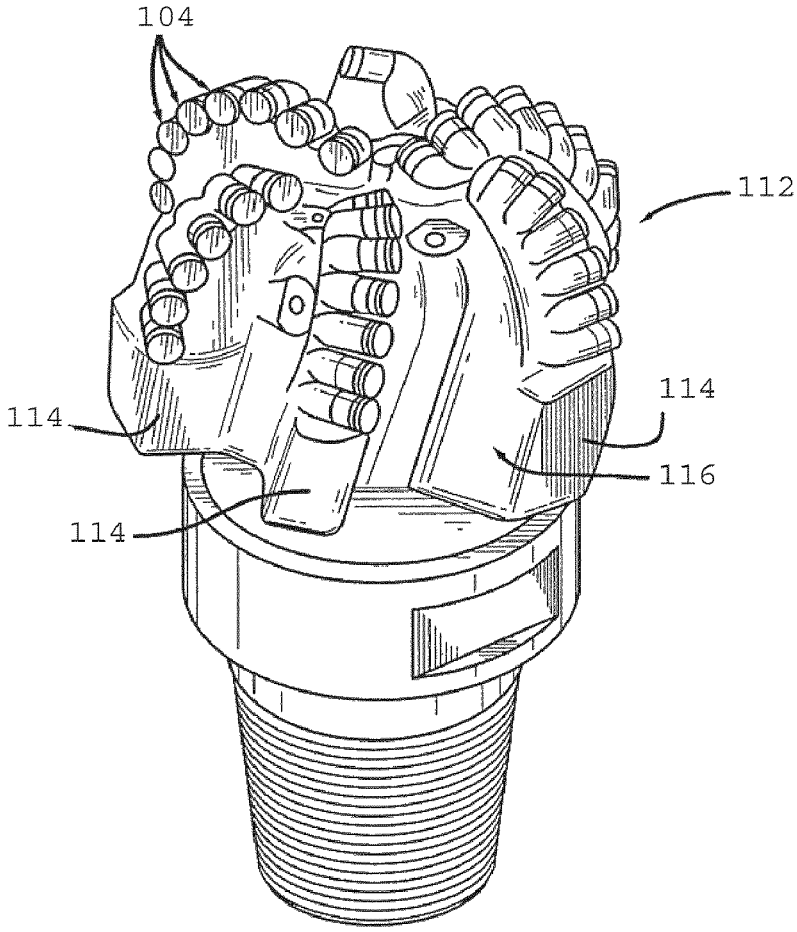
FIG. 12 is a perspective side view of a drag bit comprising a number of the shear cutters of FIG. 11.

FIG. 12 illustrates a drag bit 112 comprising a plurality of the shear cutters 104 described above and illustrated in FIG. 11. The shear cutters are each attached to blades 114 that extend from a head 116 of the drag bit for cutting against the subterranean formation being drilled.

Other modifications and variations of diamond-bonded constructions as described and illustrated herein will be apparent to those skilled in the art. For example, while the example construction embodiments described above and illustrated depict interface surfaces between the diamond-bonded body and substrate that are planar, it is to be understood that such interfacing surfaces can be nonplanar. It is, therefore, to be understood that within the scope of the appended claims, this invention may be practiced otherwise than as specifically described.

What is claimed is:

1. A diamond-bonded construction comprising:

a polycrystalline diamond body comprising a plurality of diamond-to-diamond bonded crystals forming a matrix phase, and a plurality of interstitial regions disposed between the diamond-to-diamond bonded crystals, the polycrystalline diamond body comprising;

a first diamond-bonded region comprising the matrix phase and a Group VIII metal selected from the CAS version of the Periodic Table in the interstitial regions; and a second diamond-bonded region adjacent the first region and comprising the matrix phase and a reaction product disposed within the interstitial regions, the reaction product being formed between the diamond crystals in the matrix phase and a reactant material, wherein the reactive material is selected from materials capable of infiltrating the diamond body interstitial regions to form the reaction product, the second diamond-bonded region being substantially free of a catalyst material that is used to initially form the diamond-to-diamond bonded body and extending a depth from a surface of the diamond body; and a material layer disposed over at least a portion of an outer surface of the polycrystalline diamond body, the material layer being formed from the reaction product.

2. The construction as recited in claim 1 wherein the material comprising the reactive material has a melting temperature that is below the melting temperature of the Group VIII metal in the first diamond-bonded region.

3. The construction as recited in claim 1 wherein the first diamond-bonded region is substantially free of the catalyst material.

4. The construction as recited in claim 1 wherein the Group VIII metal in the first diamond-bonded region is the catalyst material.

5. The construction as recited in claim 1 wherein the reactive material is selected to form the reaction product at high pressure/high temperature conditions.

6. The construction as recited in claim 1 wherein the material layer is disposed on an outer surface of the second diamond-bonded region.

7. The construction as recited in claim 1 wherein the material layer is substantially free of diamond crystals.

8. The construction as recited in claim 1 wherein the second diamond-bonded region has a thickness of less than about 0.1 mm.

9. The construction as recited in claim 1 wherein the second diamond-bonded region has a thickness of greater than about 0.1 mm.

10. The construction as recited in claim 1 wherein the reaction product is a carbide.

11. The construction as recited in claim 1 wherein the reaction product has a thermal characteristic that more closely matches that of the diamond crystals when compared to the catalyst material.

12. The construction as recited in claim 1 wherein the reaction product increases the thermal stability of the second diamond-bonded region.

13. The construction as recited in claim 1 wherein the reaction product increases the graphitization temperature of the second diamond-bonded region.

14. The construction as recited in claim 1 wherein the reactive material is titanium and the reaction product is titanium carbide.

15. The construction as recited in claim 1 wherein the interstitial regions of the second diamond-bonded region further comprises a material that does not form a reaction product with the diamond crystals.

16. The construction as recited in claim 1 further comprising a metallic substrate attached to the diamond-to-diamond bonded body, the substrate being attached to the first diamond-bonded region.

17. A bit for drilling subterranean formations comprising a body and a plurality of cutting elements attached thereto, one or more of the cutting elements comprising the construction as recited in claim 1.

18. The construction as recited in claim 1 wherein the diamond-bonded body has a diamond volume content at one location that is different from a diamond volume content at another location.

19. The construction as recited in claim 1 wherein the diamond grains at one location of the diamond-to-diamond bonded body are sized differently from the diamond grains at another location of the diamond-to-diamond bonded body.

20. The construction as recited in claim 1, wherein the material layer has a thickness in the range of from about 0.5 micrometers to 50 micrometers.

21. The construction as recited in claim 1, wherein the material layer covers an entire top surface of the second diamond-bonded region.

22. A diamond-bonded construction comprising:

a polycrystalline diamond body having a material microstructure comprising a plurality of bonded-together diamond crystals forming a matrix phase, and a plurality of interstitial regions disposed between the bonded-together diamond crystals, the polycrystalline diamond body including;

a first diamond-bonded region comprising the matrix phase and a Group VIII metal selected from the CAS public version of the Periodic Table disposed within the interstitial regions;

a second diamond-bonded region adjacent the first region and comprising the matrix phase and a titanium carbide reaction product disposed within the interstitial regions, the titanium carbide reaction product being formed by reaction between the diamond crystals in the matrix phase and titanium in the interstitial region at high pressure/high temperature conditions, wherein the second diamond-bonded region is substantially free of a catalyst material used to form the diamond-bonded body, wherein the second diamond-bonded region has a thickness of from about 0.02 mm to about 0.09 mm; and a material layer disposed on at least a portion of an outer surface of the polycrystalline diamond body and that is formed from the reaction product; and a metallic substrate that is attached to the polycrystalline diamond body first diamond-bonded region.

23. The construction as recited in claim 22 wherein the first diamond-bonded region is substantially free of the catalyst material.

24. The construction as recited in claim 22 wherein the material layer is formed from titanium carbide and has a thickness in the range of from about 0.005 mm to 0.03 mm.

25. The construction as recited in claim 22 wherein the material layer extends along at least a portion of a top and sidewall surface of the second diamond-bonded region.

26. The construction as recited in claim 22 wherein the second diamond-bonded region has a thickness of from about 0.03 mm to 0.05 mm.

27. A bit for drilling subterranean formations comprising a body and a plurality of cutting elements attached thereto, one or more of the cutting elements comprising the construction as recited in claim 16.

28. A bit for drilling subterranean formations comprising a body and a plurality of cutting elements attached thereto, one or more of the cutting elements comprising a diamond-bonded construction comprising:

a polycrystalline diamond body comprising a plurality of bonded-together diamond crystals forming a matrix phase, and a plurality of interstitial regions disposed between the bonded-together diamond crystals, the polycrystalline diamond body comprising:

a first diamond-bonded region comprising the matrix phase and a Group VIII metal disposed within the interstitial regions; and a second diamond-bonded region adjacent the first region and comprising the matrix phase and a reaction product disposed within the interstitial regions, the reaction product being formed between the diamond crystals in the matrix phase and a reactant material in an infiltrant material, wherein the reactive material is selected from materials capable of infiltrating the diamond body interstitial regions to form the reaction product, the second diamond-bonded region being substantially free of a catalyst material used to form the diamond-bonded body and extending a depth from a surface of the diamond body; and a material layer disposed on at least a portion of an outer surface of the polycrystalline diamond body and that is formed from the reaction product; and a substrate that is attached to the polycrystalline diamond body and selected from the group consisting of ceramic materials, metallic materials, and cermet materials.

29. The bit as recited in claim 28 wherein the body includes a number of legs extending therefrom, and a cone rotatably disposed on one a journal extending from a respective leg, wherein the cutting elements are disposed on the cone.

30. The bit as recited in claim 29 wherein the body includes a number of blades projecting outwardly therefrom, and wherein the cutting elements are disposed on the blades.

31. The bit as recited in claim 29 wherein the cutting elements that disposed along a surface of the body.

* * * * *